US012336579B2

(12) United States Patent
Harris et al.

(10) Patent No.: US 12,336,579 B2
(45) Date of Patent: Jun. 24, 2025

(54) MAGNETIC FASTENER SYSTEM

(71) Applicant: Lion Group, Inc., Dayton, OH (US)

(72) Inventors: Richard H. Harris, Beavercreek, OH (US); Audriana LaNell Cantrell, Ezel, KY (US); Kathryn Ann York, Tipp City, OH (US); Alysha Lynn Gray, Beavercreek, OH (US)

(73) Assignee: LION GROUP, INC., Dayton, OH (US)

( * ) Notice: Subject to any disclaimer, the term of this patent is extended or adjusted under 35 U.S.C. 154(b) by 277 days.

(21) Appl. No.: 17/374,194

(22) Filed: Jul. 13, 2021

(65) Prior Publication Data

US 2022/0007767 A1 Jan. 13, 2022

Related U.S. Application Data

(60) Provisional application No. 63/058,537, filed on Jul. 30, 2020, provisional application No. 63/051,073, filed on Jul. 13, 2020.

(51) Int. Cl.
*A41F 1/00* (2006.01)
*A41D 31/06* (2019.01)
(Continued)

(52) U.S. Cl.
CPC ..... *A41F 1/002* (2013.01); *A41D 31/06* (2019.02); *A41H 37/001* (2013.01); *A44B 1/18* (2013.01); *A44D 2203/00* (2013.01)

(58) Field of Classification Search
CPC ..... A41F 1/002; A44D 2203/00; A41D 31/06; A41D 3/02; A41D 3/04; A44B 1/18
See application file for complete search history.

(56) References Cited

U.S. PATENT DOCUMENTS 2,178,777 A 11/1939 Chapel
2,319,292 A 5/1943 Boggs
(Continued)

FOREIGN PATENT DOCUMENTS

CN 1308972 4/2007
DE 3503389 10/1986
(Continued)

OTHER PUBLICATIONS

Neodymium Magnet with Red Dot to Indicate North Pole, accessed from Amazon https://www.amazon.com/Neodymium-Strongest-Powerful-Magnets-Applied/dp/B01MSTKTSF (Year: 2016).*
(Continued)

*Primary Examiner* — Patrick J. Lynch
*Assistant Examiner* — Brianna T. Duckworth
(74) *Attorney, Agent, or Firm* — Thompson Hine LLP

(57) ABSTRACT

A garment including a body having a first garment portion and a second garment portion, and a releasable fastener configured to releasably couple the first garment portion to the second garment portion. The garment further includes a covering flap movable between a covering position wherein the covering flap covers the releasable fastener and a retracted position wherein the covering flap does not cover the releasable fastener. The garment has a magnetic fastener system configured to selectively retain the covering flap in the covering position.

41 Claims, 14 Drawing Sheets

(51) Int. Cl.
*A41H 37/00* (2006.01)
*A44B 1/18* (2006.01)

(56) References Cited

U.S. PATENT DOCUMENTS

| | | | | |
|---|---|---|---|---|
| 2,389,298 | A | 11/1945 | Ellis | |
| 2,397,931 | A | 4/1946 | Ellis | |
| 2,507,322 | A | 5/1950 | Smith | |
| 2,800,660 | A | 7/1957 | Myrick | |
| 2,893,012 | A | 7/1959 | Kahn | |
| 3,008,209 | A | 11/1961 | Kurt | |
| 3,009,225 | A | 11/1961 | Budreck | |
| 3,086,268 | A | 4/1963 | Chaffin, Jr. | |
| 3,161,932 | A | 12/1964 | Russell | |
| 3,171,176 | A | 3/1965 | Shirley | |
| 3,231,899 | A | 2/1966 | Seidel et al. | |
| 3,833,938 | A | 9/1974 | Shweid | |
| 4,249,267 | A | 2/1981 | Voss | |
| 4,399,595 | A | 8/1983 | Yoon et al. | |
| 4,475,252 | A | 10/1984 | Peyser | |
| 4,825,526 | A | 5/1989 | Shenier et al. | |
| 4,879,769 | A | 11/1989 | Grilliot | |
| 5,083,319 | A | 1/1992 | Grilliot et al. | |
| 5,127,106 | A | 7/1992 | Aldridge | |
| 5,153,941 | A | 10/1992 | Grilliot et al. | |
| 5,208,951 | A | 5/1993 | Aoki | |
| 5,249,338 | A | 10/1993 | Aoki | |
| 5,253,394 | A | 10/1993 | Morita | |
| 5,274,850 | A | 1/1994 | Aldridge | |
| 5,274,853 | A | 1/1994 | Millican | |
| 5,450,658 | A | 9/1995 | Hicks | |
| 5,604,960 | A * | 2/1997 | Good | A41F 1/002 24/66.1 |
| 5,638,547 | A | 6/1997 | Hewitt | |
| 5,682,653 | A | 11/1997 | Berglof et al. | |
| 5,692,240 | A | 12/1997 | Steele | |
| 5,884,332 | A | 3/1999 | Snedeker | |
| 5,983,464 | A | 11/1999 | Bauer | |
| 5,991,924 | A | 11/1999 | Grilliot | |
| 6,038,700 | A | 3/2000 | Aldridge et al. | |
| 6,163,889 | A | 12/2000 | Tate | |
| 6,370,692 | B1 * | 4/2002 | Duyn | A41D 3/02 2/202 |
| 6,374,414 | B1 | 4/2002 | Collier | |
| 6,378,174 | B1 * | 4/2002 | Wong | A45C 13/1069 24/66.1 |
| 6,434,801 | B2 | 8/2002 | Grunberger | |
| 6,687,913 | B2 | 2/2004 | Aldridge | |
| 6,829,847 | B2 | 12/2004 | O'Shea et al. | |
| 6,934,970 | B1 | 8/2005 | Watkins et al. | |
| 6,972,654 | B1 | 12/2005 | Brock | |
| 7,039,958 | B2 | 5/2006 | Henricksen | |
| 7,065,841 | B2 | 6/2006 | Sjoquist | |
| 7,178,207 | B2 | 2/2007 | Wong et al. | |
| 7,187,261 | B2 | 3/2007 | Cassar | |
| 7,597,126 | B2 | 10/2009 | Chen | |
| D627,950 | S | 11/2010 | Carpentier | |
| RE44,271 | E | 6/2013 | Keeter | |
| 8,662,682 | B2 | 3/2014 | Gorodisher et al. | |
| 9,210,953 | B2 | 12/2015 | Horton | |
| 9,301,564 | B2 | 4/2016 | Roeckelein | |
| 9,364,040 | B2 | 6/2016 | Saladino | |
| 9,521,873 | B1 | 12/2016 | Mignone | |
| 9,549,580 | B2 | 1/2017 | Horton | |
| 9,572,386 | B1 * | 2/2017 | Scheer | A41D 11/00 |
| 10,478,644 | B2 | 11/2019 | Leggett et al. | |
| 2002/0178551 | A1 | 12/2002 | Hsu | |
| 2004/0158910 | A1 | 8/2004 | Bay | |
| 2004/0181845 | A1 | 9/2004 | Droppo | |
| 2004/0226195 | A1 | 11/2004 | Martinez | |
| 2006/0048267 | A1 | 3/2006 | Keeter | |
| 2006/0048293 | A1 | 3/2006 | Lewis | |
| 2007/0266476 | A1 | 11/2007 | Ulrich | |
| 2008/0104742 | A1 | 5/2008 | Alperin et al. | |
| 2008/0163404 | A1 | 7/2008 | Carpentier | |
| 2008/0282443 | A1 | 11/2008 | Curtis | |
| 2009/0178245 | A1 | 7/2009 | Albert | |
| 2009/0283197 | A1 | 11/2009 | Gorodisher | |
| 2009/0320176 | A1 | 12/2009 | Curtis | |
| 2009/0320181 | A1 | 12/2009 | Macgregor, Jr. | |
| 2010/0269239 | A1 | 10/2010 | Kulp et al. | |
| 2012/0079688 | A1 | 5/2012 | Bunting | |
| 2012/0233748 | A1 * | 9/2012 | Curtis | A41D 13/00 2/455 |
| 2013/0117902 | A1 | 5/2013 | Aresty et al. | |
| 2014/0041093 | A1 | 2/2014 | Korobkin | |
| 2014/0109303 | A1 * | 4/2014 | Curtis | A62B 17/003 2/455 |
| 2014/0130231 | A1 * | 5/2014 | Horton | A41F 1/002 2/93 |
| 2014/0259266 | A1 | 9/2014 | Federlin | |
| 2015/0047105 | A1 * | 2/2015 | Fonzo | A41F 1/002 2/265 |
| 2015/0079558 | A1 | 3/2015 | Blackburn | |
| 2017/0196280 | A1 * | 7/2017 | Murphy | A41D 13/1161 |
| 2018/0116305 | A1 | 5/2018 | Cheuk | |
| 2019/0110527 | A1 * | 4/2019 | Ghasletwala | A41F 1/002 |
| 2019/0110538 | A1 | 4/2019 | Ghasletwala | |
| 2019/0116894 | A1 | 4/2019 | Brannon | |
| 2019/0261710 | A1 | 8/2019 | Branan | |
| 2020/0229516 | A1 | 7/2020 | Curran | |
| 2020/0268060 | A1 | 8/2020 | Siraguda | |

FOREIGN PATENT DOCUMENTS

| | | | |
|---|---|---|---|
| DE | 2020 05020354 | U1 | 4/2006 |
| EP | 0 691 017 | | 7/1998 |
| EP | 1 264 553 | | 12/2002 |
| EP | 1 529 459 | | 5/2005 |
| GB | 854589 | | 11/1960 |
| GB | 2242816 | A | 10/1991 |
| GB | 2 282 955 | | 4/1995 |
| JP | 2005-028022 | | 2/2005 |
| JP | 2013241686 | A | 12/2013 |
| KR | 10-1914508 | | 10/2018 |
| KR | 20180114687 | A | 10/2018 |
| WO | 2006/002592 | | 1/2006 |
| WO | 2016/160648 | | 10/2016 |
| WO | 2019055061 | A1 | 3/2019 |
| WO | 2019/111595 | A1 | 6/2019 |
| WO | 2019/162740 | A1 | 8/2019 |

OTHER PUBLICATIONS

Hand2Mind Ceramic Bar Magnet, accessed from Amazon https://www.amazon.com/hand2mind-1-5-Inch-Ceramic-Magnets-Classroom/dp/B01MT1PF1P (Year: 2016).*

EP, Extended European Search Report; European Patent Application Serial No. 20189023.3, 6 pages (Jan. 22, 2021).

Koga et al., Machine Translation—JP 2005-28022 A, pp. 1-9.

City of Bolivar; "Specifications and Documents for Fire Fighting Turnout Gear for City of Bolivar"; 18 pages (Sep. 2014).

Condor Golf, LLC; "EZ Loader Magnetic Headcover" product information; 6 pages (at least as early as Jun. 2020).

Titleist—Titleist 909D Driver Headcover Magnetic 909-D Golf Club Cover product description; 1 page (at least as early as Jun. 2020).

You Sew Girl!; "How to make sew-in-magnets"; available at https://nicolerndesign.blogspot.com/2008/12/how-to-make-sew-in-magnets.html; 8 pages (Dec. 8, 2008).

Documentation relating to a firefighter garment shown to a potential customer; 6 pages (May 2019).

European Patent Office, Extended European Search Report issued Dec. 21, 2023, which pertains to EP Application No. 23202101.4. 7 pgs.

European Patent Office, Extended European Search Report, European Patent Application No. 23202104.8, 7 pages, Jan. 30, 2024.

Canadian Intellectual Property Office, Examination Report, Canadian Patent Application No. 3217673, 5 pages, Feb. 18, 2025.

Canadian Intellectual Property Office, Examination Report, Canadian Patent Application No. 3217678, 5 pages, Feb. 13, 2025.

(56) References Cited

OTHER PUBLICATIONS

Canadian Intellectual Property Office, Examination Report, Canadian Patent Application No. 3217592, 4 pages, Mar. 20, 2025.

* cited by examiner

MAGNETIC FASTENER SYSTEM

This application claims priority to U.S. Provisional Patent Application No. 63/051,073 filed on Jul. 13, 2020 and entitled Magnetic Fastener System, and to U.S. Provisional Patent Application No. 63/058,537 filed on Jul. 30, 2020 and entitled Magnetic Fastener System. The entire contents of both of those patent applications are incorporated herein by reference.

This application relates to a magnetic fastener system, and more particularly, to a magnetic fastener system for use with protective garments.

BACKGROUND

Protective or hazardous duty garments are used in a variety of industries and settings to protect the wearer from hazardous conditions such as heat, smoke, cold, sharp objects, chemicals, liquids, fumes and the like. The protective garments often include closures to secure portions of the garment. However, existing closures may not be sufficiently easy to operate and/or sufficiently durable.

SUMMARY

In one embodiment the invention is a garment including a body having a first garment portion and a second garment portion, and a releasable fastener configured to releasably couple the first garment portion to the second garment portion. The garment further includes a covering flap movable between a covering position wherein the covering flap covers the releasable fastener and a retracted position wherein the covering flap does not cover the releasable fastener. The garment has a magnetic fastener system configured to selectively retain the covering flap in the covering position.

DETAILED DESCRIPTION

Figure 1:
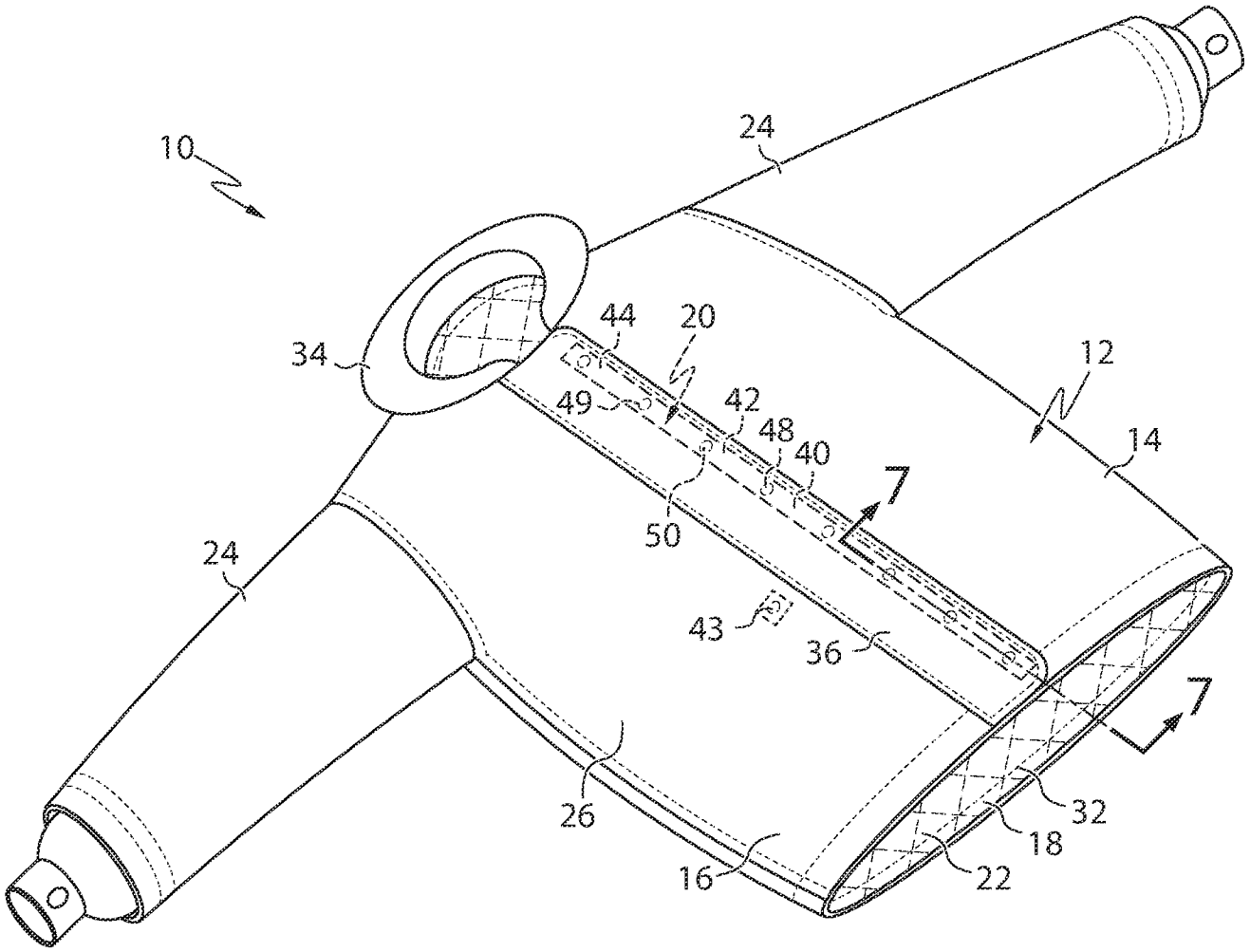
FIG. 1 is a front perspective view of a coat, having a storm flap in a closed position.
Figure 2:
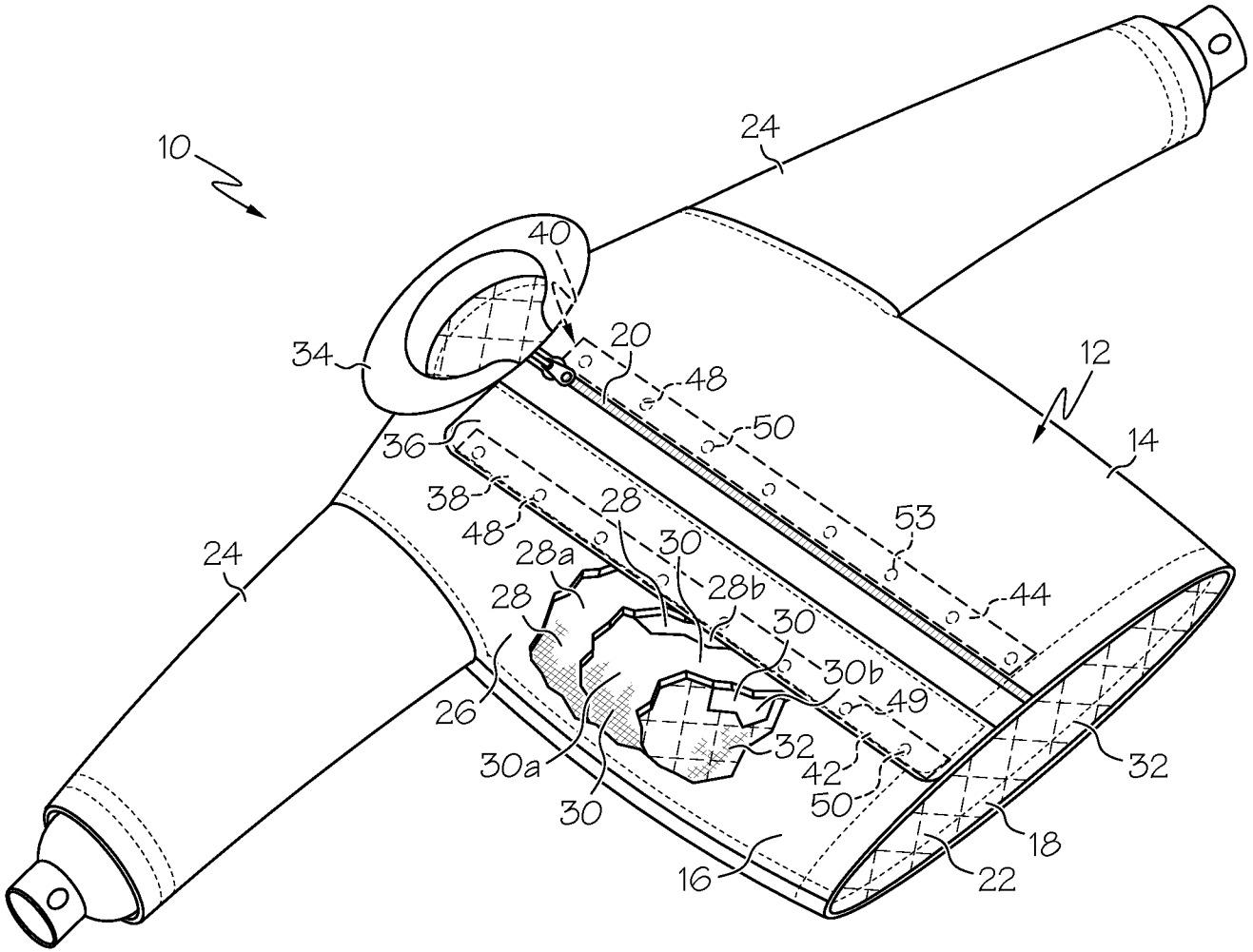
FIG. 2 is a front perspective view of the coat of FIG. 1, with portions of various layers cut away, and showing the storm flap in a retracted position.

FIGS. 1 and 2 illustrate a protective or hazardous duty garment in the form of a firefighter's garment or coat, generally designated 10. The coat 10 may include a body or body portion 12 having a left front panel or first garment portion 14, right front panel or second garment portion 16 and a back panel 18. The left front panel 14 and right front panel 16 may be releasably attachable by a fastener or coat fastener 20, such as a zipper, snaps, clasps, clips, hook-and-loop fastening material (e.g., VELCRO® fastening material), magnets, combinations of these components or the like. The body portion 12 may define a torso cavity 22 that is shaped and configured to receive a wearer's torso therein. The coat 10 may include a pair of sleeves 24 coupled to and extending generally outwardly from the body portion 12 and shaped to receive a wearer's arms therein.

The coat 10 may include various layers through its thickness to provide various heat, moisture and/or abrasion resistant qualities to the coat 10 so that the coat 10 can be used as a protective, hazardous duty, and/or firefighter garment. For example, the coat 10 may include an outer shell, outer layer or outer material 26, a moisture barrier 28 located inside of and adjacent to the outer shell 26 (e.g. positioned between the outer shell 26 and the torso cavity 22), a thermal liner or barrier 30 located inside of and adjacent to the moisture barrier 28, and an inner liner or face cloth 32 located inside of and adjacent to the thermal barrier 30.

The outer shell 26 may be made of or include a variety of materials, including a flame, heat and abrasion resistant material such as a compact weave of aramid fibers and/or polybenzamidazole fibers. Commercially available aramid materials include NOMEX and KEVLAR fibers (both trademarks of E.I. DuPont de Nemours & Co., Inc. of Wilmington, Delaware), and commercially available polybenzamidazole fibers include PBI fibers (a trademark of PBI Performance Fabrics of Charlotte, North Carolina). Thus, the outer shell 26 may be an aramid material, a blend of aramid materials, a polybenzamidazole material, a blend of polybenzamidazole fibers, a blend of aramid and polybenzamidazole materials, a poly- phenylene benzobisoxazole (PBO) material, a thermostable organic polymer material, such as KERMEL material sold by Kermel SAS of Colmar, France, a blend of any of the materials listed above, or other appropriate materials.

If desired, the outer shell 26 may be coated with a polymer, such as a durable, water repellent finish or coating (i.e. a perfluorohydrocarbon finish, such as TEFLON finish sold by E. I. Du Pont de Nemours and Company of Wilmington, Delaware, or a fluorine free water repellent finish). The materials of the outer shell 26 may have a weight of, for example, between about five and about ten oz./yd$^2$. Moreover, if desired the outer shell 26 may have a self-decontaminating finish or coating applied thereto.

The moisture barrier 28 and thermal barrier 30 may be generally coextensive with the outer shell 26, or spaced slightly inwardly from the outer edges of the outer shell 26 (i.e., spaced slightly inwardly from the outer ends of the sleeves 24, the collar 34 and/or from the lower edge or hem of the coat 10) to provide moisture and thermal protection throughout the coat 10. The moisture barrier 28 may include a semi-permeable membrane layer 28*a* and a substrate 28*b*. The membrane layer 28*a* may be generally water vapor permeable but generally impermeable to liquid moisture. The membrane layer 28*a* may be made of or include expanded polytetrafluoroethylene ("PTFE") such as GORE-TEX or CROSSTECH materials (both of which are trademarks of W.L. Gore & Associates, Inc. of Newark, Del.), STEDAIR particulate barrier material sold by Stedfast, Inc. located in Quebec Canada, polyurethane-based materials, neoprene-based materials, cross-linked polymers, polyamid, or other materials. The membrane layer 28*a* may have microscopic openings that permit moisture vapor (such as water vapor) to pass therethrough, but block liquids (such as liquid water) from passing therethrough. The membrane layer 28*a* may be made of a microporous material that is either hydrophilic, hydrophobic, or somewhere in between. The membrane layer 28*a* may also be monolithic and may allow moisture vapor transmission therethrough by molecular diffusion. The membrane layer 28*a* may also be a combination of microporous and monolithic materials (known as a bicomponent moisture barrier), in which the microporous or monolithic materials are layered or intertwined.

The membrane layer 28*a* may be bonded, adhered or otherwise coupled to a substrate 28*b* of a flame and heat resistant material to provide structure and protection to the membrane layer 28*a*. Thus, either the membrane layer 28*a* alone, or the membrane layer 28*a* in combination with the moisture barrier substrate 28*b*, may be considered to constitute the moisture barrier 28. The substrate 28*b* may be or include aramid fibers similar to the aramid fibers of the outer shell 26, but may be thinner and lighter in weight. The substrate 28*b* may be woven, non-woven, spunlace or other materials. In the illustrated embodiment, the membrane layer 28*a* is located between the outer shell 26 and the substrate 28*b*. However, the orientation of the moisture barrier 28 may be reversed such that the substrate 28*b* is located between the outer shell 26 and the membrane layer 28*a*.

The thermal barrier 30 may be made of nearly any suitable flame resistant material that provides sufficient thermal insulation. In one embodiment, the thermal barrier 30 may include a layer of bulk material 30*a* in the form of relatively thick (i.e. between about 1/16"-3/16") batting, felt or needled non-woven bulk or batting material. The bulk material 30*a* can include aramid fiber batting (such as NOMEX batting), aramid needlepunch material, an aramid non-woven material, an aramid blend needlepunch material, an aramid blend batting material, an aramid blend non-woven material, foam (either open cell or closed cell), or other suitably thermally insulating materials. The bulk material 30*a* may trap air and possess sufficient loft to provide thermal resistance to the coat 10.

The bulk material 30*a* may be quilted or otherwise coupled to a thermal barrier face cloth 30*b* which can be a weave of a lightweight aramid material. Thus, either the bulk material 30*a* alone, or the bulk material 30*a* in combination with the thermal barrier face cloth 30*b*, may be considered to constitute the thermal barrier 30. In the illustrated embodiment, the thermal barrier bulk material 30*a* is located between the outer shell 26 and the thermal barrier face cloth 30*b*. However, the orientation of the thermal barrier 30 may be reversed such that the thermal barrier face cloth 30*b* is located between the outer shell 26 and the bulk layer 30*a*. If desired, the thermal barrier 30 may be treated with a water-resistant or water-repellent finish. In one embodiment, the thermal barrier 30 (and/or the coat 10 as a whole) may have a thermal protection performance ("TPP"), as specified in the 1986 revision of the National Fire Protection Association ("NFPA") 1971, Protective Clothing for Structural Fire Fighting Standards, of at least about twenty, and the coat 10 as a whole may have a TPP of at least about thirty-five, although the TPP values can vary.

Although the moisture barrier 28 is shown as being located between the outer shell 26 and the thermal barrier 30, the positions of the moisture barrier 28 and thermal barrier 30 may be reversed such that the thermal barrier 30 is located between the outer shell 26 and the moisture barrier 28, or additional moisture barrier 28 and/or thermal barrier layers 30 can be utilized or various other orientations or configurations may be used.

The face cloth 32 may be the innermost layer of the coat 10, located inside the thermal barrier 30 and moisture barrier 28. The face cloth 32 can be made of, for example, chambray fabric and provide a comfortable surface for the wearer and protect the thermal barrier 30 and/or moisture barrier 28 from abrasion and wear. The face cloth 32 may be quilted to the adjacent layer (i.e. the thermal barrier 30 in the illustrated embodiment). However, the face cloth 32 is optional and may be excluded if desired. In addition, the coat 10 may not necessarily include the moisture barrier 28 and/or the thermal barrier 30 in certain cases.

Each layer of the coat 10 disclosed herein, including the layers and components described above, as well as those described below, and the coat 10 as a whole and other garments disclosed herein, may meet the National Fire Protection Association ("NFPA") 1971 standards for protective firefighting garments ("Protective Clothing for Structural Firefighting"), which standards as of the filing date of this application are entirely incorporated by reference herein. The NFPA standards specify various minimum requirements for heat and flame resistance and tear strength. For example, in order to meet the NFPA standards, the outer shell 26, moisture barrier 28, thermal barrier 30 and face cloth 32 must be able to resist igniting, burning, melting, dripping, separation, and/or shrinking more than 10% in any direction after being exposed to a temperature of 500° F. for at least five minutes. Furthermore, in order to meet the NFPA standards, the combined layers of the coat 10 must provide a TPP rating of at least thirty-five.

Alternately or in addition to the NFPA Standard 1971, the coat 10 and other garments disclosed herein may meet standards of other countries or regions, including the European Norm ("EN") standards for firefighting garments set by the European Committee for Standardization (also known as Comité Européen de Normalisation ("CEN")). These standards include EN 469:2005 Level 1 and Level 2 certification. The EN standards for firefighter and protective garments in place as of the filing date of this application are entirely incorporated by reference herein.

Figure 3:
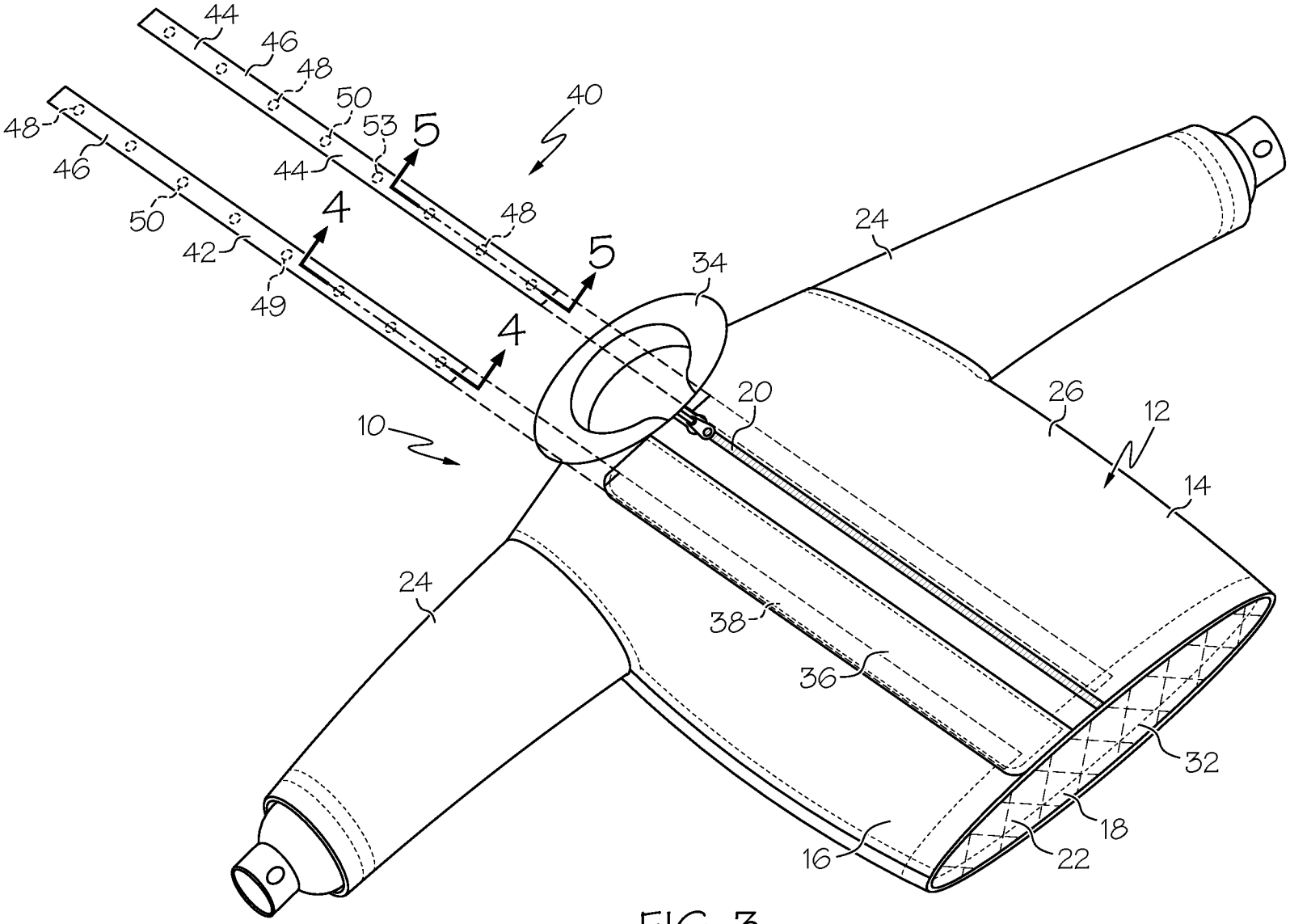
FIG. 3 is a front perspective view of the coat of FIG. 2, with the flap and body components exploded outwardly therefrom.

As shown in FIGS. 1-3, the coat 10 may include a storm flap or covering flap 36 that is configured to selectively cover and protect the fastener 20. The storm flap 36 can in one case be made of or include the same materials described above for the material of the outer shell 26. In one case the storm flap 36 is made of two plies of the material of the outer shell 26 that are secured together such that an abrasion-resistant outer surface of the outer shell 26 faces outwardly on both sides of the storm flap 36, and a storm flap cavity 38 is positioned therein.

The storm flap 36 can extend generally the entire length/height of the coat 10/fastener 20 and be pivotable about an axis extending along its length between a closed/covering position (FIG. 1) wherein the storm flap 36 generally covers, overlies and/or is positioned over the fastener 20, and an open/retracted position (FIG. 2) wherein the storm flap 36 is spaced away from, and generally does not cover or overlie, or is not positioned over, the fastener 20. The storm flap 36 can be permanently coupled to one of the panels 14, 16 (such as by stitching in one case), and releasably coupled to the other one of the panels 14, 16 when in the covering position. The storm flap 36 may be pivotable when moving between the covering and retracted positions.

The coat 10 may include a magnetic fastener system 40 which can be used to secure the storm flap 36 in the closed/covering position, and extends parallel to and adjacent to the fastener 20. The magnetic fastener system 40 of FIGS. 1-11 can include a first or flap component/device 42 which is coupled to (in one case, inserted in) the storm flap 36, and a second or body component/device 44 which is coupled to (in one case, inserted in) the body or fixed portion of the coat 10, adjacent to the fastener 20. The flap component 42 and body component 44 (or portions thereof) are magnetically attracted to each other, particularly when the storm flap 36 is in the closed position, to magnetically couple and retain the storm flap 36 in the closed position. Additionally or alternatively, the flap component 42 and body 12/right front panel 16 (or portions thereof or other components) can be magnetically attracted to each other when the storm flap 36 is in the open position, to magnetically couple and retain the storm flap 36 in the open position, as will be described in greater detail below.

Figure 4:
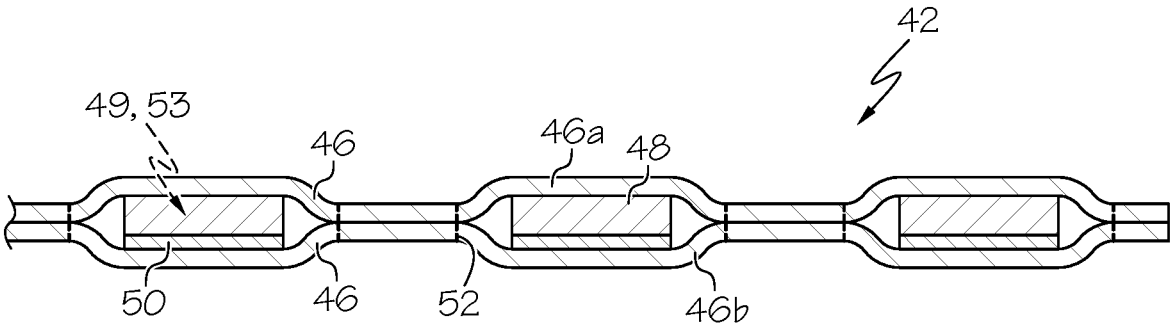
FIG. 4 is a side cross-section taken along line 4-4 of FIG. 3.
Figure 5:
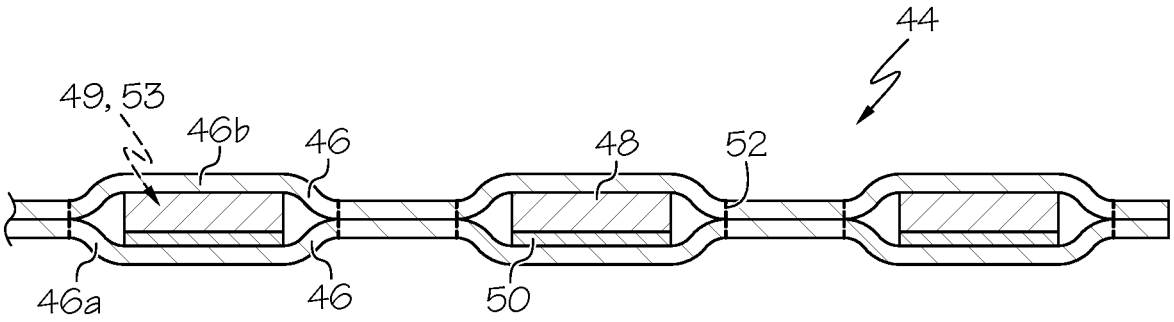
FIG. 5 is a side cross-section taken along line 5-5 of FIG. 3.

As shown in FIGS. 3-5, the flap component 42 and body component 44 can each include a backing or support strip 46 of generally flexible material, a plurality of spaced-apart magnets 48 coupled to or forming part of the support strip 46 or supported thereby, and a plurality of backing members or strike plates 50 positioned between at least part of the support strip 46 and the magnets 48. The support strip 46 can be made of a relatively thin, pliable aramid and fire-resistant and flame-resistant material that is manually bendable such as, in one case, a woven material, a knit material, a non-woven material, a pressure-sensitive tape with a cloth or mesh backing such as duct tape, or the like. The support strip 46 provides a supporting material upon which the magnets 48/backing members 50 can be positioned, and in one case the support strip 46 extends continuously the entire length of the associated component 42, 44.

Figure 6:
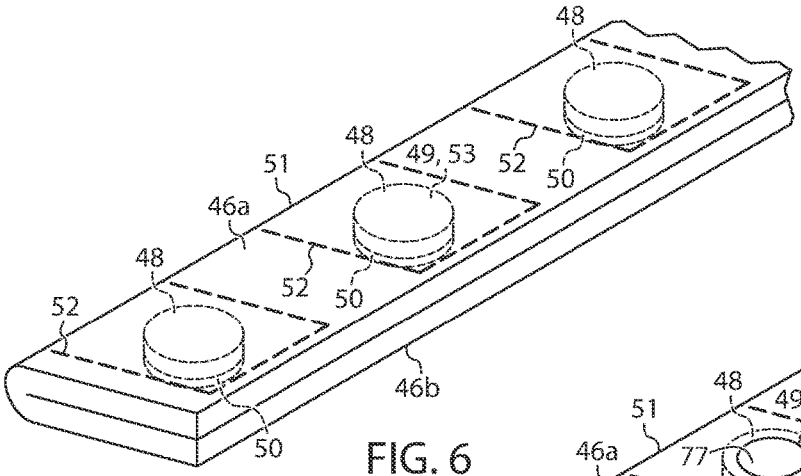
FIG. 6 is a partial front perspective front view of a flap component or body component.

In the illustrated embodiment, each support strip 46 includes an inner ply 46*a* and an outer ply 46*b*, with the magnets 48 and backing members 50 positioned between the two plies 46*a*, 46*b*. The plies 46*a*, 46*b* can, in one case, be entirely separate pieces of material, or in another case (as shown in FIG. 6) both plies 46*a*, 46*b* are formed from a single piece of material, folded about itself along a longitudinal fold or crease line 51. Further alternately, each support strip 46 can be made of only a single ply 46*a* or 46*b*.

The plies 46*a*, 46*b* can be made of the same or different materials, and in one case are made of a fire resistant textile or fabric, such as aramid, para-aramid or fire resistant cotton material, an E-88 material such as a spunlace flame-resistant meta-aramid material or fabric such as NOMEX material or KEVLAR material. In one embodiment, the flap component 42 and body component 44 and/or the associated support strips 46, at least after assembly, are generally water tight such that the magnets 48 and/or backing members 50 positioned therein are generally or completely fluidly sealed from each other and/or the surrounding environment to protect the magnets 48 and backing members 50 and/or first magnet coupling components 49 and/or second magnetic coupling components 53 (as defined below) from moisture, corrosive chemicals, oxygen or the like. In one case, as will be described in greater detail below, the two plies 46*a*, 46*b* can be coupled to each other in a facial bond, such as by sonic welding or the like, to form a waterproof seal.

Each of the magnets 48 is, in the illustrated embodiment, generally flat and circular in front view, taking the form of "button" magnets, with their poles oriented perpendicular to the flat end surfaces. In one case the magnets 48 are "solid" and continuous magnets that lack any hole or opening formed therethrough, particularly any center hole/opening and/or any hole/opening through a center thereof. Such a magnet 48 provides ease of construction/assembly, and results in a magnet 48 which is stronger, more robust, and has a better magnetic response such that it is more magnetically attracted to the other magnet(s) 48 and/or backing plates 50. However, the magnets 48 can have any wide variety of shapes and configurations. In one embodiment the magnets 48 are each generally flat and have a relatively small thickness, such as less than about one-half in one case, or less than about one-quarter in another case, of the longest dimension (such as length or diameter) of the magnet 48.

The magnets 48 may in one case have a pull force (either magnet-to-magnet or magnet-to-magnetizable plate) of between about 10 lbs. and about 20 lbs. at a distance of 0 inches, and between about 0.5 lbs. and about 5 lbs. at a distance of 0.2 inches. In one case, the pull force provided by the magnets 48 is selected to be similar to the pull force required to open typical hook-and-loop fasteners used in firefighter turnout gear. The magnets 48 can be permanent magnets made of various materials, and in one case are rare earth magnets, such as neodymium magnets (in one case N48 magnets or 48 MGO megagauss oersteds magnets) with a nickel or other corrosion resistant coating (shown as layer 39 in FIG. 11G). A given component 42, 44 may have all of its magnets 48 arranged in the same polarity (e.g. with their poles facing the same direction) or the magnets 48 can be arranged to have varying polarity, such as an alternating polarity in one case.

As noted above, the flap component 42 and/or body component 44 can also include the plurality of backing members 50, each of which is located between a magnet 48 and at least one ply 46*a*, 46*b* of the support strip 46. Each backing member 50 can be made of a material which is non-magnetic but magnetizable, such as ferrous metals, including steel with a nickel or other corrosion resistant coating (see layer 39 in FIG. 11G), or the like. Each backing member 50 can have a size and shape (in front view) that generally corresponds to a size and shape of the corresponding magnet 48. For example, when the magnets 48 are generally circular in front view, each of the backing members 50 can also be circular in front view and have the same or approximately the same radius. Each backing member 50 may have a radius and/or surface area in front view that is within about +/−10 percent of the radius/surface area of the associated magnet 48. In one case each backing member 50 is generally flat, and lacks any holes/openings and lacks any raised lip about a perimeter thereof (or elsewhere/anywhere) and thus is not a cup, and/or lacks any axially-extending pin or protrusion, such as a pin or protrusion located at a center thereof. Providing a generally flat backing member 50 provides ease of construction/assembly, reduces catch points, and results in a backing member 50 which is stronger, more robust, and has a better magnetic response such that it is more magnetically attracted to the associated magnet 48.

Each backing member 50 can have a thickness that is less than a thickness of the magnets 48 since in some cases the thinner material may be sufficient to provide the desired functionality (described below) of the backing member 50. In one case each backing member 50 has thickness that is less than about one half, or less than about one third in another case, of the thickness of the associated magnet 48.

The magnets 48/backing members 50 are, in one case, discrete, spaced-apart components that are regularly spaced along the entire length of the support strip 46 and have a spacing therebetween of at least about ½ inch in one case, or at least about one inch in another case, and less than about six inches in another case. This spacing can provide sufficient magnetic connections without causing undue efforts by the wearer in making and breaking magnetic connections, and while providing sufficiently low weight.

As noted above, additionally or alternatively, the flap component 42 and body 12/right front panel 16 (or portions thereof) can be magnetically attracted to each other when the storm flap 36 is in the open/retracted position, to magnetically couple and retain the storm flap 36 in the open position. In this case, as shown in FIG. 1, a magnet component 43 (which can be a magnet 48 and/or strike plate 50; and can be considered part of the magnetic fastener system 40 in one case; and/or can be considered a third magnetic coupling component) can be positioned on the panel 16 to magnetically interact with the flap component 42 and magnetically retain the flap component 42 in the open position. Although only a single magnet component 43 is shown, more than one magnet component 43, such as a line of magnet components 43 extending parallel to the storm flap 36, may be used.

The backing members 50 can aid in securing the magnets 48 to the support strip 46 during manufacture/assembly of the components 42, 44. In particular, the handling and placement of magnets 48 can in some cases be challenging since machines and equipment typically are made of or include metal or other magnetizable materials, which can cause the magnets 48 to move and/or stick to the machines or equipment during assembly. This can, in turn, make it difficult to precisely locate the magnets 48 on the support strip 46.

Figure 11A:
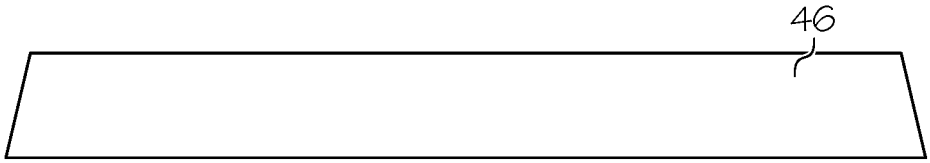
FIGS. 11A, 11B, 11C, 11D, 11E, 11F and 11G are a series of view showing a method for manufacturing a flap or body component.
Figure 11B:
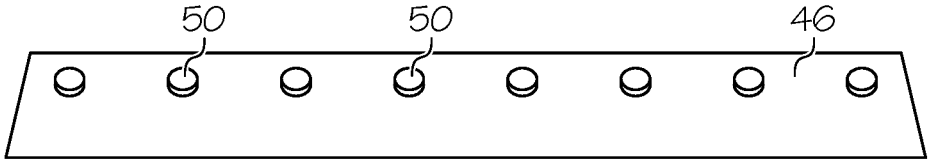
Figure 11C:
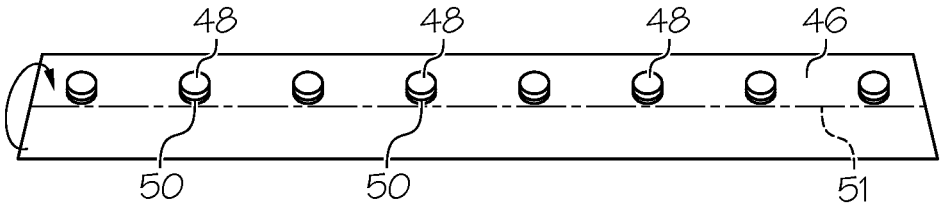
Figure 11D:
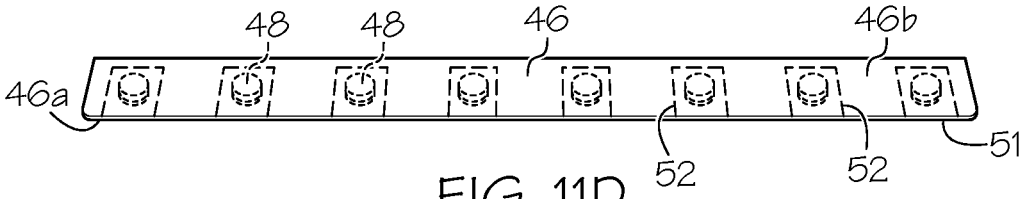

Since the backing members 50 can be made of a non-magnetic material, it is relatively simple and straightforward during manufacturing/assembly to supply a support strip 46 (FIG. 11A) and locate the backing members 50 at the desired positions on the support strip 46 (FIG. 11B). For example, in one case each backing member 50 can be simply adhered to the desired location on one ply 46*a*, 46*b* of the support strip 46. Each magnet 48 can then be simply dropped in place on the backing member 50 (FIG. 11C). The other ply 46*a*, 46*b* can then be placed in position and/or folded in place on top of the magnets 48 and backing members 50 (folding about fold line 51 as shown by the arrow of FIG. 11*c*). Next stitching 52, if implemented, can be applied (FIG. 11D). Due to the magnetic attraction and the generally corresponding size/shape, each magnet 48 can be easily aligned with the associated backing member 50 to thereby properly align and couple each magnet 48 to the support strip 46. If desired an adhesive 47 (see FIG. 11G) can be positioned between the backing member 50 and magnet 48 to secure those components together.

During use of the coat 10, the backing members 50 may provide protective/shunting effects to reduce certain undesirable effects of the magnets 48. In particular, by shunting the magnetic field of the magnets 48, the backing members 50 reduce the ability of the magnets 48 of components 42 and 44 to attract loose, magnetizable items such as tools, metal portions of the wearer's other garments, etc. In addition, the backing members 50 of the body component 44 shunt or reduce inwardly-facing magnetic field of the magnet 48 to reduce any potential magnetic interference with any medical devices on or in the wearer's body, while the outwardly-facing magnetic field of the magnets 48 of body component 44, which is utilized for closure/attraction, is not effected. However, as will be described in greater detail below it should be understood that the backing members 50 are optional, and when the backing members 50 are not utilized the magnets 48 can be directly coupled to/retained in the associated support strip 46 (e.g. in one case, positioned in contact with both plies of the support strip 46) and/or backing members can be used in place of the magnets 48 on one of the components 42, 44.

After or while the magnets 48 (and backing members 50, if utilized) are placed on the associated support strip 46, the magnets 48 and backing members 50 can be secured in place. In one embodiment, when both magnet 48 and backing members 50 are used on a single component 42, 44 only the backing members 50 (and not the magnets 48) are secured to the support strip 46, such as by adhesives. Such adhesive can be applied during manufacturing/assembly, or may be pre-existing on the support strip 46, such as when the strip 46 includes or takes the form of pressure-sensitive adhesive tape. When the backing members 50 are directly secured to the strips 46, such as by an adhesive, due to the magnetic attraction between the magnets 48 and the backing members 50, it may not be required to separately secure each magnet 48 directly to the support strip 46.

Figure 9:
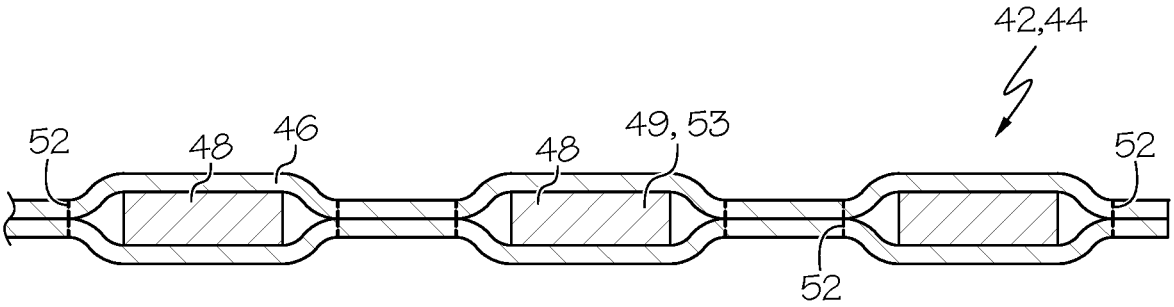
FIG. 9 is an alternate side cross-section taken along line 4-4 and/or line 5-5 of FIG. 3.
Figure 10:
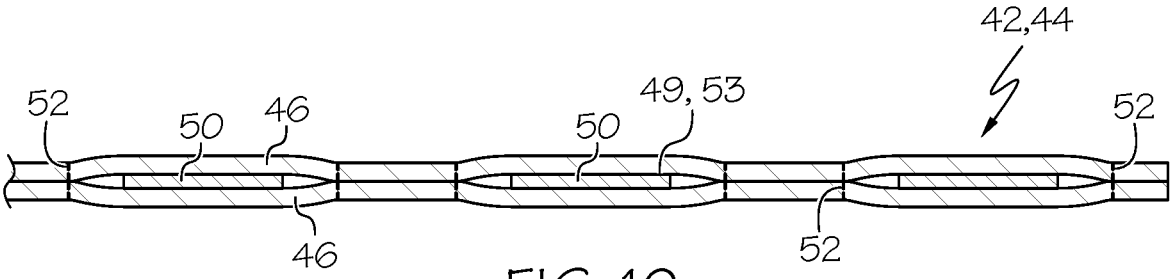
FIG. 10 is another alternate side cross-section taken along line 4-4 and/or line 5-5 of FIG. 3.

However, the magnets 48 and/or backing members 50 can be secured in place by a variety of methods. For example, as shown in FIGS. 4-11, in one case stitching 52 is positioned around/adjacent to each magnet 48/backing member 50 to essentially lock each magnet 48/backing member 50 in place and limit the motion/travel thereof. The stitching 52 can extend around any free edges of the support strip 46 (e.g. any edges of the support strip 46 that are not formed by the fold 51) and for example extend across a lateral width of the support strip 46 and through the thickness of the support strip 46, and also extend longitudinally to form a closed, or generally closed perimeter around each magnet 48/backing member 50. However, various other methods, mechanisms and means can be utilized to secure the magnets 48/backing members 50 to the support strips 46. For example, in place of or in addition to the stitching 52, the plies 46*a*, 46*b* of the support strip 46 can be made of or include sonically bondable materials with a sonic bonding layer 69 positioned therebetween as shown in FIG. 11G. In this case the plies 46*a*, 46*b* can be sonically bonded together about their facing surfaces to trap the magnets 48 and/or backing members 50 in place and form a strong and waterproof/water-resistant bond.

Figure 11E:
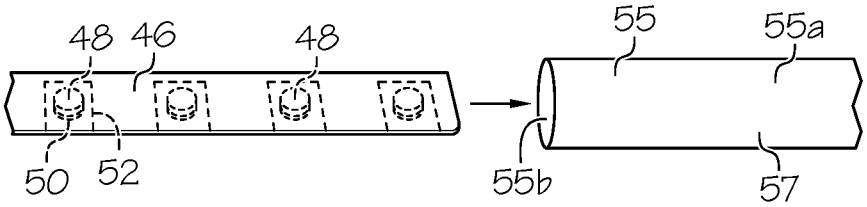
Figure 11F:
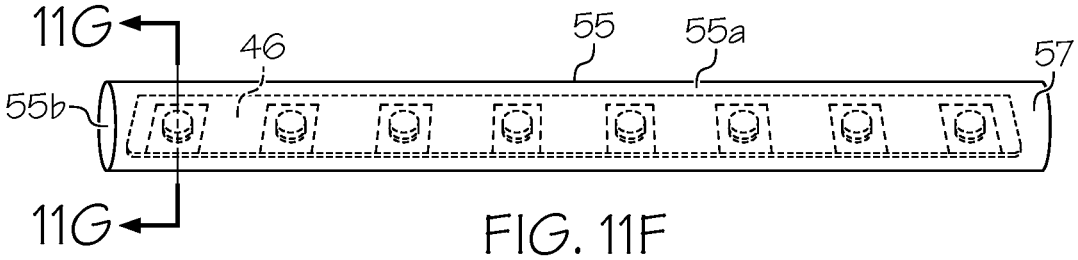
Figure 11G:
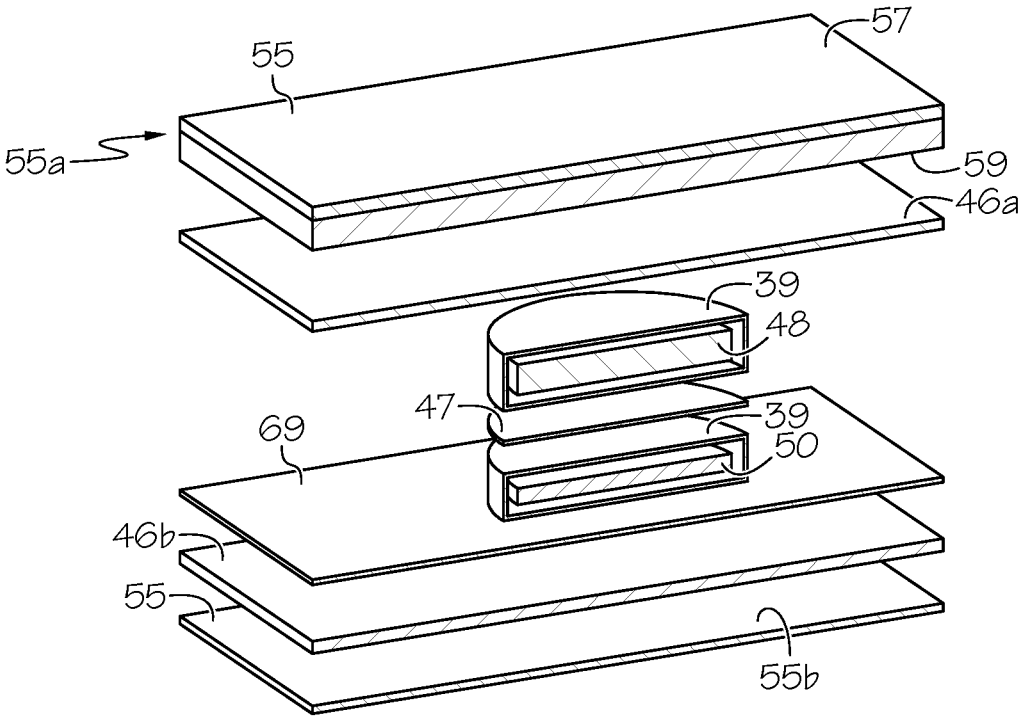

As shown in FIG. 11E, in one case a tube or tubular member 55 can be provided, into which the support strip 46, with magnets 48/backing members 50 is inserted. The tube 55 can in one case be permanently coupled to the coat 10, and positioned in the storm flap cavity 38, at the time the support strip 46 is inserted into the tube 55. Alternatively, the support strip 46 is inserted into the tube 55, and the tube 55/support strip 46 are then together inserted into storm flap cavity 38 and then coupled to the coat 10.

The tube 55 can have two plies 55*a* and 55*b*, and be made of a variety of materials. In one embodiment the inner ply 55a (located closer to a wearer of the garment 10 in one case) is made of an outer material or fabric 57 such as an E-88 material such as a spunlace flame-resistant meta-aramid material or fabric such as NOMEX material, and an inner layer 59 such as a foam, and more particularly a closed cell foam to providing cushioning and protection to the support strip 46 and magnets 48/backing members 50. The outer ply 55*b* of the tube 55 (located more distant from a wearer of the garment 10) can in one case be made of a para-aramid material. In one case, the outer ply 55*b* is made of a relatively thin material (thinner than inner ply 55*a*, in one case due to the foam layer 59). Making the outer ply 55*b* of relatively thin material reduces the distance between the magnets 48/backing members 50 of the support strip 46, relative to the other support strip 46, to provide increased magnetic response and attraction. Alternatively both plies 55*a*, 55*b* of the tube 55 can be made of the same material, including any of the materials outlined above for any layer or ply 55*a*, 55*b* of the tube S5, and combinations thereof.

Figure 7:
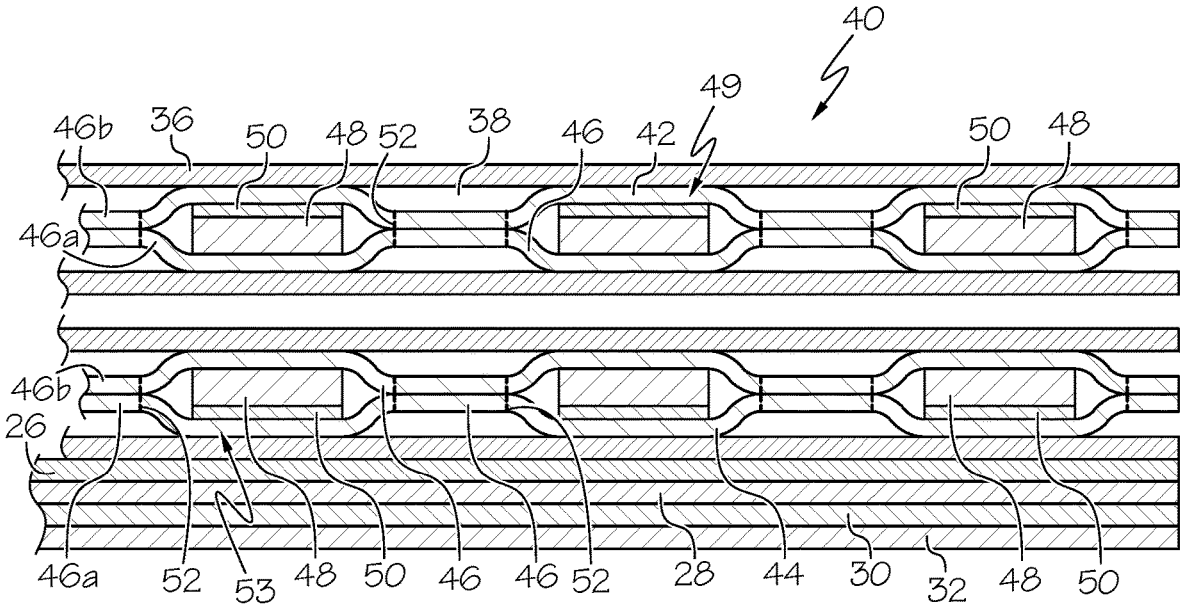
FIG. 7 is a side cross-section taken along line 7-7 of FIG. 1, with the flap component and the body component slightly spaced away from each other.
Figure 8:
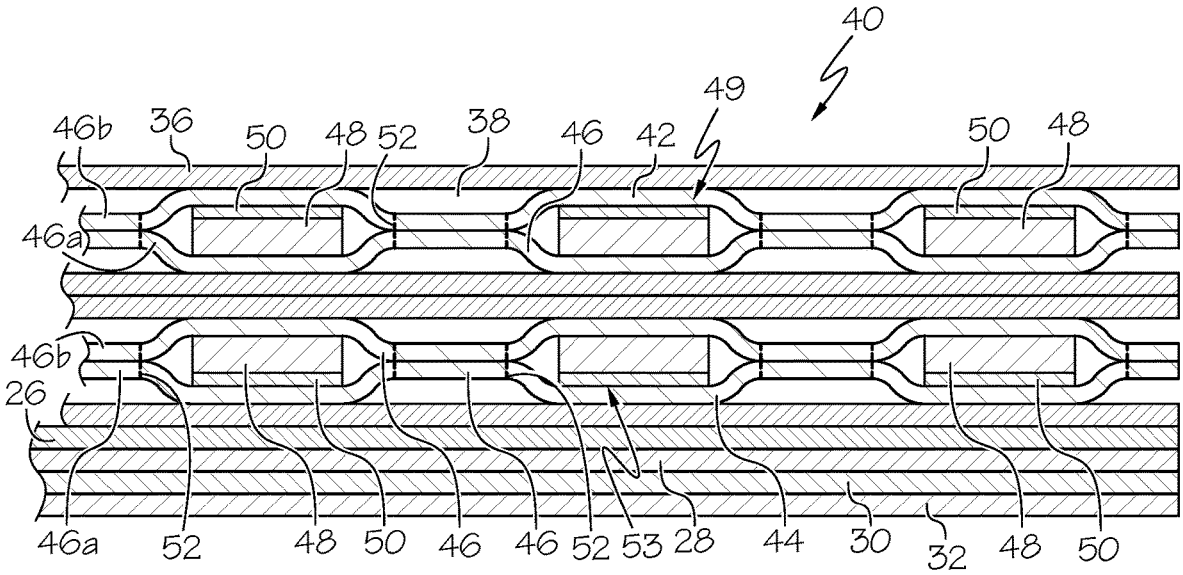
FIG. 8 shows the components of FIG. 7, with the flap component and the body component in contact with each other.

The magnets 48 of the flap component 42 can be arranged such that their poles are opposite to the poles of the magnets 48 of the body component 44, when the flap component 42 and body component 44 are stacked on top of/positioned adjacent to each other in a thickness direction, as shown in FIGS. 1, 7 and 8. Thus, when the storm flap 36 is moved from its retracted position (FIG. 2) to the engaged position (FIGS. 1 and 8) the magnets 48/backing members 50 of the flap component 42 magnetically interact with the magnets 48/backing members 50 of the body component 44 to magnetically couple the components 42, 44 thereby retaining the storm flap 36 in its closed position. Also, the magnets 48/backing members 50 of the flap component 42 can magnetically interact with the magnets 48/backing members 50 of the body component 44 to magnetically couple the components 42, 44 thereby retaining the storm flap 36 in its open position. For the sake of clarity, it is noted that the magnetic coupling component 53 on the body 12 positioned to hold the storm flap 36 closed can take the form of a magnetizable material such as backing members 50, and/or can take the form of magnets 48 as a magnetic coupling component 53.

The magnets 48/backing members 50 of the flap component 42 can generally have a spacing that corresponds to a spacing of the magnets 48/backing members 50 of the body component 44. In one case, the geometric centers of the magnets 48/backing members 50 of one component 42, 44 are generally aligned with the geometric centers of the magnets 48/backing members 50 of the other component 42, 44 (such as when the storm flap 36 is in the closed or covering position). In another case each magnet 48/backing member 50 of one components 42, 44 can at least partially overlap with a corresponding magnet 48/backing member 50 of the other component 42, 44, in a direction perpendicular to the thickness of the coat 10, such as when the storm flap 36 is in the closed position.

In an alternate embodiment, as noted above and shown in FIG. 9, one or both of the flap component 42 or body component 44 may lack the backing member 50, and the component 42, 44 includes only the magnets 48 directly coupled to the associated support strip 46 by adhesives, stitching, or other mechanisms as described above. In yet another alternate embodiment, as shown in FIG. 10 one or the other of the flap component 42 or body component 44 can utilize, instead of magnets 48, a magnetizable or metal material, or magnetizable body, such as in one case the backing member 50. The magnetizable body in this case can have generally the same qualities and configuration as the backing members 50 outlined above, or can have different qualities such as differing size, shape, thickness, etc., but in any case may be of a magnetizable material that is not a permanent magnetic material, which can be magnetically attracted to the magnet 48 and/or magnet 48/backing member 50 of the other component 42, 44.

In the embodiment of FIGS. 4-8, when magnets 48 and backing members 50 are used, the magnets 48 (or the magnets 48 along with the associated backing members 50) of the flap component 42 can be termed first or flap magnetic coupling components 49, and the magnets 48 (or the magnets 48 along with the associated backing members 50) of the body component 44 can be termed second or body magnetic coupling components 53. When the embodiment of FIG. 9 is utilized, the magnet 48 can be termed a first or flap magnetic coupling component 49, or a second or body magnetic coupling component 53, depending upon the location of the magnet 48 of FIG. 9 on either the flap component 42 or body component 44 of the coat 10. When the embodiment of FIG. 10 is utilized, the magnetizable body/backing members 50 can also be termed a first or flap magnetic coupling component 49, or a second or body magnetic coupling component 53, depending upon the location of the component 50 of FIG. 10 on either the flap component 42 or body component 44 of the coat 10. It should be understood that when the embodiment of FIG. 10 is utilized, it can be utilized in either the flap component 42 or the body component 44, but the other one of the flap component 42 or body component 44 would include a magnet 48 (either with or without a backing member 50).

When the magnetic coupling components 49, 53 of both the flap component 42 and the body component 44 take the form of magnets 48, or more particularly magnets 48 with a backing member 50 as shown in FIG. 8, flap component 42 and body component 44 provide the benefit of being self-aligning. In particular, when the magnets 48 are brought together, they will be attracted to each other via their polarities such that the magnets 48 are concentrically aligned to ensure that the storm flap 36 is not only closed, but also positioned in the proper configuration. In contrast, when one of the flap component 42 or body component 44 takes the form of the embodiment of FIG. 10 (e.g. when one set of magnetic coupling components 49, 53 are not magnets), the storm flap 36 will be securely retained in its closed position, but will not necessarily be self-aligning. However, assembly and manufacture of the embodiment of FIG. 10 may be easier and more inexpensive since magnets 48 are not included in one of the components 42, 44.

The flap component 42 and body component 44 can each be relatively long, linear strips having a length significantly greater than their width. For example, each of the flap component 42 and body component 44 can be generally flat and elongated, and have a length at least about five times the width thereof in one case, or at least about ten times greater than the width thereof in another case. As shown in FIG. 3, each flap component 42 and body component 44 (along with the tube 55, if utilized) can be received within a pocket, slot or the like (such as the cavity 38 of the storm flap 36 and body 12 of the coat 10) in the associated garment portions and if desired secured therein by loops similar to belt loops, or snaps, hook-and-loop fastening material, or other fastening systems. Thus, the flap component 42 and body component 44 may be removably coupled to the coat 10 for ease of manufacture, repair, cleaning of the coat 10, etc.

Figure 12:
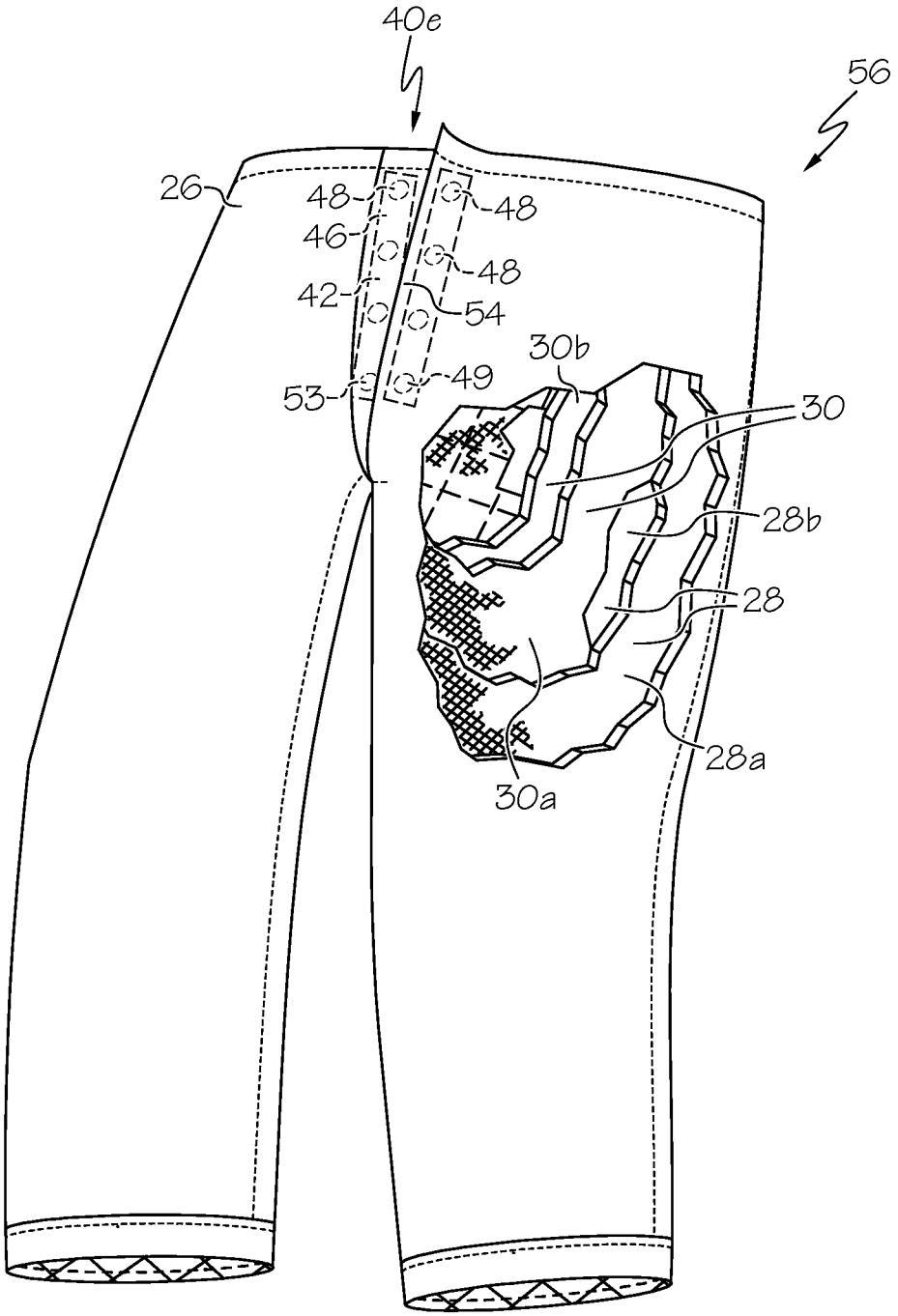
FIG. 12 is a front perspective view of a pair of trousers with a magnetic fastener system along the fly of the trousers.
Figure 13:
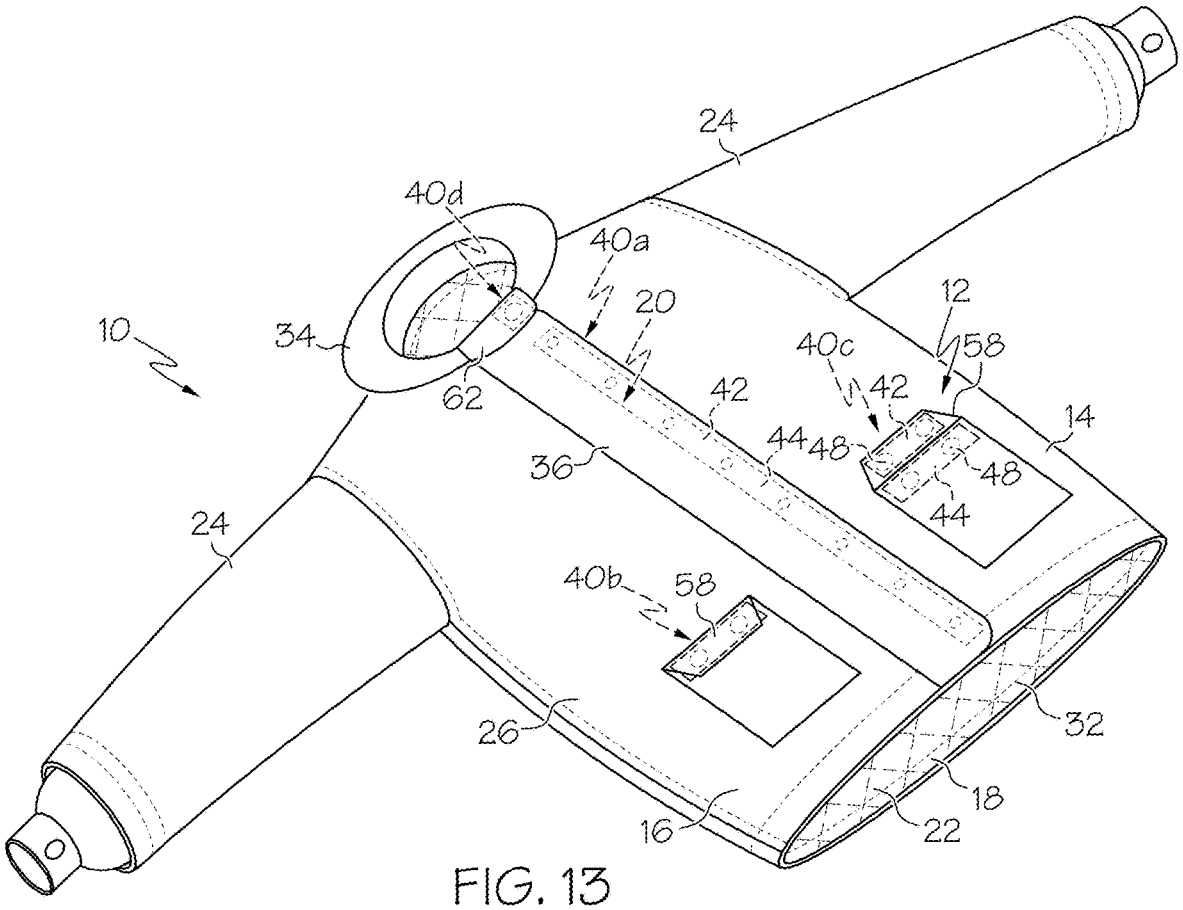
FIG. 13 shows a coat for use in conjunction with a magnet closure supply system.
Figure 13A:
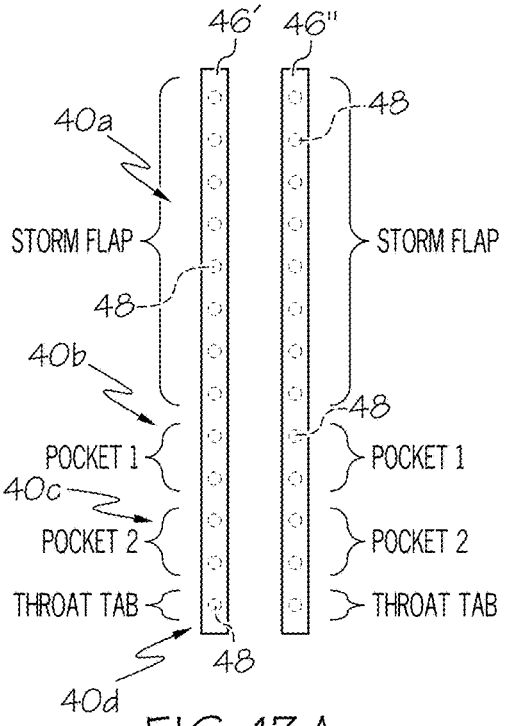
FIG. 13A is a schematic representation of a magnet closure supply system for use with the coat of FIG. 13.
Figure 13B:
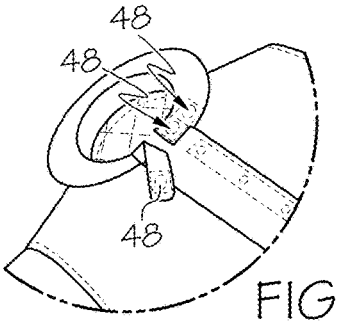
FIG. 13B shows the throat tab of the garment of FIG. 13 in a retracted position.

As noted above, the magnetic fastener system 40 can in one case be utilized to secure the storm flap 36 in its closed position (shown as magnetic fastening system 40a in FIGS. 13 and 13A). As also mentioned above, the magnetic fastening system 40 can also or instead be utilized to secure the storm flap 36 in the open position, which corresponding changes to the positioning of the body component 44 (e.g. the body component 44 can be positioned below the storm flap 36, when the storm flap 36 is in its open or retracted position shown in FIG. 2). Moreover, the magnetic fastener system 40 can additionally, or instead, be used to secure various other portions of the coat 10, such as securing pocket flaps 58 in the closed position (FIG. 13) (shown as magnetic fastening systems 40*b*, 40*c* in FIGS. 13 and 13A), securing a throat tab or movable collar 62 (FIGS. 13 and 13B, shown as magnetic fastening system 40*d* in FIG. 13A, and also shown in FIGS. 14-19), securing the fly 54 of a pair of trousers 56 (shown as magnetic fastening system 40*e* in FIG. 12), etc. where the associated components are received in cavities of the garment 10, 56 in the appropriate position. In the embodiment of FIG. 12, the trousers 56 may include a traditional mechanical fastener, such as a zipper, hook-and-loop fastener, or other components described above for the fastener 20, and the fly 54 is a protective cover or covering flap positionable over the traditional fastener in the same manner that the storm flap 36 covers the fastener 20.

In the embodiment of FIGS. 13, 13A and 13B, and as outlined above, the magnetic fastening system 40*d* for securing the throat tab or movable collar 62 can have a magnet 48 on the movable throat tab 62, and two magnets 48 of an opposite polarity on the body 12 of the coat 10. This enables the throat tab 62 to be coupled to the body 12 to a left one (relative to a wearer) of the magnets 48 to provide a relatively tight fit for the throat tab 62, or be coupled to the right one of the magnets 48 to provide a relatively loose fit. Although two magnets 48 are shown, if desired the body 12 of the coat 10 can include only one magnet 48 or more than two magnets 48; and in addition or alternatively the throat tab 62 can have two or more magnet 48. In addition it should be understood that instead of magnets 48, the throat tab 62 and/or body 12 of the coat 10 can utilize a strike plate 50 and/or a strike plate 50 in combination with a magnet 48 (e.g. first, second and third magnetic coupling components) to provide magnetic attraction as outlined above, and plies 46*a*, 46*b* etc. as used in conjunction with the strips 46 as outlined above.

Moreover, the magnetic fastener system 40 can be used in any of a wide variety of garments beyond protective and fire fighter garments and indeed used in any of a wide variety of applications, systems or methods. For example, FIG. 12 illustrates a pair of trousers 56 that may be able to be used in conjunction with or separately from the coat 10. The trousers 56 can be made of the same materials and layers, and in the various configurations with the same qualities as the coat 10 outlined above. The magnetic fastener system 40*e* can be utilized in connection with the fly 54 of the trousers 56 wherein the fly 54 is closed in the same or similar manner as the storm flap 36 described above.

The magnetic fastener system 40 can provide a durable, robust and protectable fastener system which retains its strength over time, including after repeated exposure to heat, laundering, etc. In addition, operation of the magnetic fastener system 40 is relatively easy. In order to separate or open the magnetic fastener system 40, the movable/pivotable component (flap 42) and the fixed component (body 44) need only be manually pulled apart, and the wearer is not required to identify any particular tabs or release mechanisms, or start fastening or unfastening at a particular location, as is required for use with zipper systems or the like. The magnetic fastener system 40 can be coupled or closed simply by pivoting the movable/pivotable component in place on or over the body portion. In addition, the magnetic fastener system 40 can be operated without fine motor skills, which can provide ease of use to a wearer who is wearing gloves, or when time is limited.

A garment, such as a coat 10 and/or trousers 56, can include multiple magnetic fastener systems 40 utilized therein. For example, as outlined above and shown in FIGS. 13, 13A and 13B, the coat 10 can include a first magnetic fastening system 40a for securing the storm flap 36, second 40*b* and third 40*c* magnetic fastening systems for securing pocket flaps 58, a fourth magnetic fastening system 40*d* for securing the throat tab 60, etc. Accordingly, in order to provide ease of manufacturing a single garment, a first continuous support strip or supply strip 46', which can provide magnets 48 and/or backing members 50 and/or magnetizable members (collectively, magnetic coupling components 49, 53), can be supplied and provides sufficient number of a first type of the magnetic coupling components 49, 53 for inclusion in an entire coat 10/garment during assembly/manufacturing. Similarly, a second support strip or supply strip 46" can be provided with a corresponding number of a second type of magnetic coupling components 49, 53.

As shown in FIGS. 13, and 13A the first strip 46' includes, in that particular illustrated embodiment, a plurality of equally spaced magnetic coupling components 49, 53 in the form of magnets 48 for a total of thirteen magnetic coupling components 49, 53. In the illustrated embodiment eight of those magnets 48/magnetic coupling components 49, 53 are allocated for/incorporated into the storm flap 36, two of the magnets 48/magnetic coupling components 49, 53 are incorporated into a flap 58 of a first pocket, two magnets 48/magnetic coupling components 49, 53 are incorporated into a flap 58 of a second pocket, and one magnet 48/magnetic coupling component 49, 53 is incorporated into the throat tab 62. The second strip 46" can include an equal number of magnetic coupling components 49, 53 (also shown as magnets 48 in the illustrated embodiment) as those included in the first strip 46' for use in the same manner. It should be understood that the magnetic coupling components 49, 53 of the strips 46', 46" of FIG. 13A can be allocated in any desired manner, and the specific allocation shown in FIG. 13A is for illustrative purposes only.

If desired, each of the strips 46', 46" can include color coding, a visual identifier or printed indicia (collectively termed "indicia" herein) or the like 77 to illustrate the polarity and/or use thereof (e.g. to indicate which component should be installed in the movable part versus the fixed/body 12 of the garment 10 and/or which side should face in which direction). For example, a segment or strip of color indicia 77 (see FIG. 6B), such as the color gold, can be positioned on one side of strip 46', 46" to mark or indicate a surface of the magnet 48 having a south pole, and a segment or strip of indicia 77 of another color (such as the color silver) can be positioned on the other side of strip 46', 46" or another strip, to mark or indicate a surface of magnets 48 having a north pole.

Figure 6A:
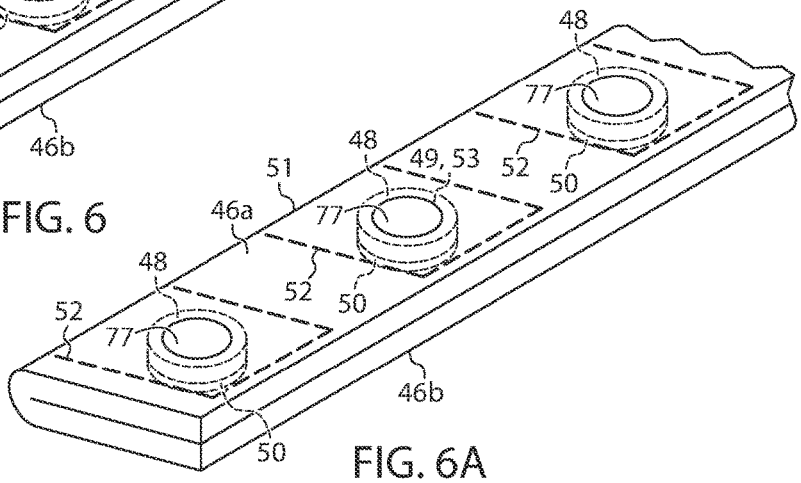
FIG. 6A is an alternate view of the flap component or body component of FIG. 6, showing one embodiment of a visual identifier or indicia.
Figure 6B:
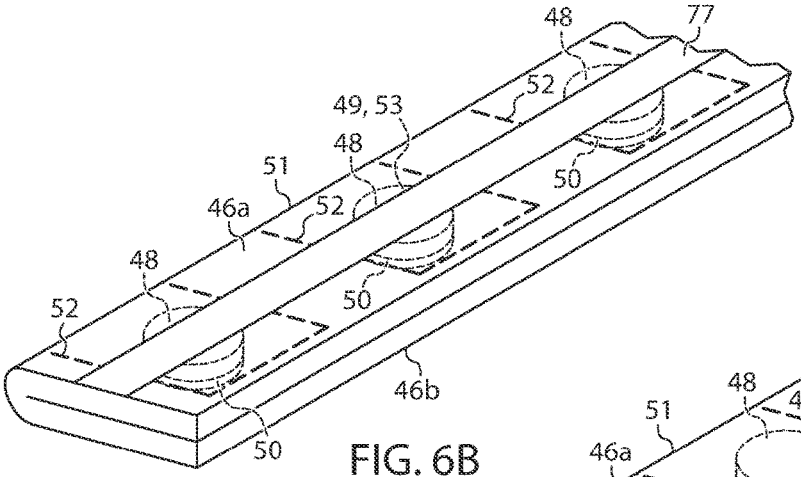
FIG. 6B is a further alternate view of the flap component or body component of FIG. 6, showing another embodiment of a visual identifier or indicia.

In the embodiment of FIG. 6A, the indicia 77 takes the form of a circular area positioned on each magnet 48 or magnetic coupling component 49/53. In this case the positioning of the indicia 77 also helps the manufacturer to visually identify the magnets 48 or magnet orientation. In the embodiment of FIG. 6B, the indicia 77 takes the form of a stripe passing over the underlying magnets 48 or magnetic coupling component 49/53. The strips 46', 46"/magnetic coupling components 49, 53 can thus if desired be differentiated from each other by the indicia 77 that is unique to the strips 46'/46" and/or the first 49 and second 53 magnetic coupling components. The indicia 77 can be integrated into the support strips 46, or separate from the support strip 46. The indicia 77 can also be used to indicate the polarity of the associated magnetic coupling components 49/53, ensuring the first magnetic coupling components 49 are paired with a magnetically attracted (once installed) second magnetic coupling component 53. The indicia 77 can prevent pairing a magnetic coupling component 49/53 with a magnetically repulsing (once installed) magnetic coupling component 49/53.

Figure 6C:
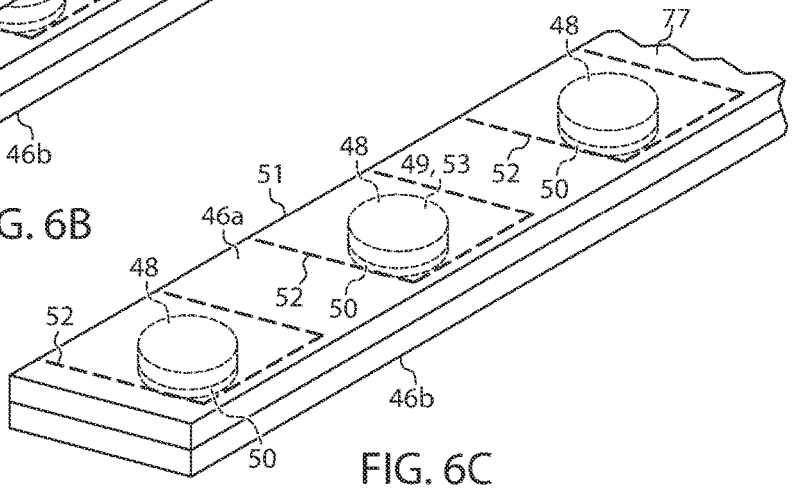
FIG. 6C is a further alternate view of the flap component or body component of FIG. 6.

FIG. 6C illustrates a further embodiment in which the plies 46*a*, 46*b* are made of separate pieces of material, which can be joined together. In addition, rather than having a separate circular area of indicia 77 as shown in FIG. 6A or a stripe of indicia 77 as shown in FIG. 6B, the entire upper surface of the inner ply 46*a* can have a colored surface to provide visual guidance to a manufacturer/assembler.

In order to utilize the strips 46', 46", the garment assembler receive the strips 46', 46", each as a continuous strip, for example in one case from a manufacturer or supplier of magnetic components. The garment assembler can simply cut or separate the strips 46', 46" at the desired locations to provide the number of desired magnetic coupling components 49, 53, and the resultant, smaller shorter strip can then be sewn or secured into the garment at the appropriate location and manner. For example, first smaller strips of the first 46' and second 46*b*" strips can be used as the flap component 42 and body component 44, second or supplemental smaller strips of the first 46' and second 46" strips can be used as part of a pocket closure system 40*b*, 40*c*, etc. Thus the strips 46', 46" can provide a convenient system for incorporating the magnetic coupling components 49, 53 in a garment which can be easily implemented during garment manufacture, and can provide a predetermined number of magnetic coupling components 49, 53 for the entire garment.

With reference to FIGS. 14-19, the protective coat 10 can include a throat tab 62 coupled to or forming a part of the coat 10. The throat tab 62 is movable/pivotable between a closed position (FIGS. 14, 15 and 18) wherein the throat tab 62 generally covers the front of the collar 64 of the coat 10 or the throat of a wearer and does not wrap around the back of the collar 64, and an open or retracted position (FIGS. 17 and 19) where the throat tab 62 is moved away from the collar 64/throat of a wearer, and generally does not cover the front of the collar 64/throat of the wearer. Moreover, when in the open or retracted position, the throat tab 62 is not necessarily retracted into the collar 64, but instead can at least partially wrap around the side and/or back of the neck/collar 64 of the coat 10, and more particularly wrap around and conform to the back of the neck/collar 64 of the coat 10, to be retained out of the way.

The throat tab 62 spans/extends across the fastener 20 when the throat tab 62 is in the closed position, and does not extend across the fastener 20 when the throat tab 62 is in the retracted position. The throat tab 62 may span, and cover, a gap 63 (FIG. 17) between the collar portions 65 of the coat 10 when the throat tab 62 is closed to provide protection. In addition, the throat tab 62 may have a vertical height, or dimension extending along a height of the coat 10, that is greater than all, or at least portions, of the collar portions 65, when the throat tab 62 is in its closed position to provide increased protection when the throat tab 62 is closed. Alternatively an upper portion/edge of the throat tab 62 is positioned above an upper portion/edge of the collar portions 65, when the throat tab 62 is closed, to provide increased protection.

The coat 10 can include a throat tab closure system 61 including a first "mechanical" or non-magnetic fastener system 66 to retain the throat tab 62 in the closed position. The mechanical fastening system 66 may in one case lack any magnetic parts in one case, and/or lack any magnetic or magnetizable parts, components or materials (such as metal, or at least sufficient metal to be magnetized and act as a fastener/closure) in another case. In particular, in the illustrated embodiment the first fastener system 66 includes a first portion 68, or portion of hook material 68, positioned on and near a distal end of the throat tab 62, and a second portion 70, or portion of loop material 70, positioned on the body 12 of the coat 10 or on the collar 64. The first or hook 68 and second or loop 70 portions can cooperate, when pressed together, to secure and retain the throat tab 62 in the closed position. Of course, if desired, the positions of the hook and loop material can be reversed such that the loop material is positioned on the throat tab 62 as the first portion 68, and the hook material is positioned on the body 12/collar 64 as the second portion 70. Moreover, it should be understood that various fasteners can be used as the non-magnetic fastener system 66 in place of the hook-and-loop fastening systems such as in one case other mechanical fasteners including snaps, loops, clasps, ties, buttons or the like.

Figure 14A:
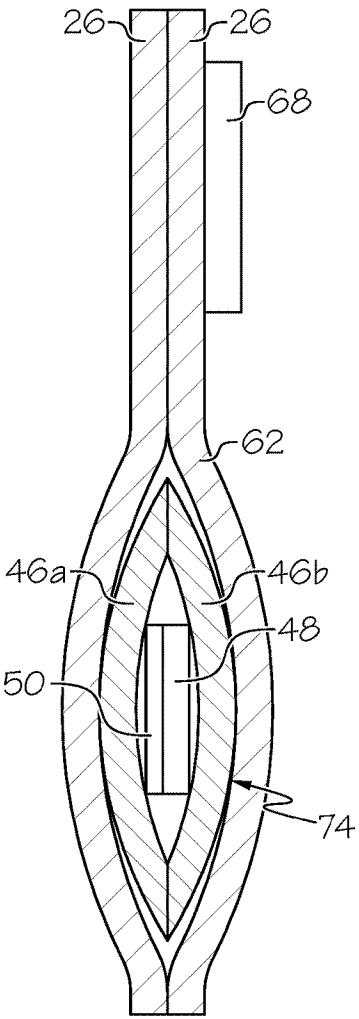
FIG. 14A is a cross section of the throat tab taken along line 14A-14A of FIG. 14.
Figure 14:
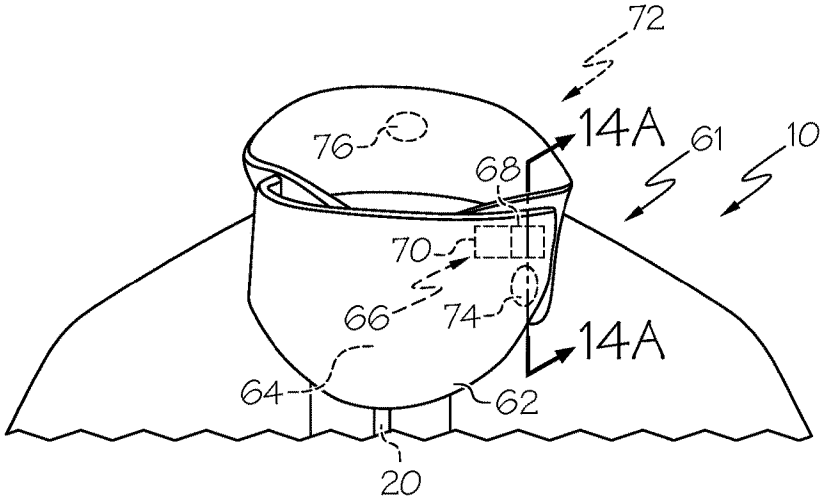
FIG. 14 is a front perspective view of a coat with a throat tab, showing the throat tab in a closed position.
Figure 15:
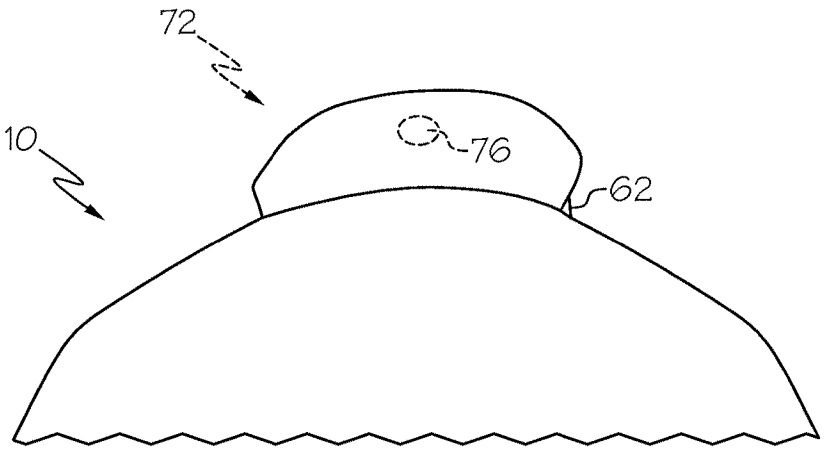
FIG. 15 is a rear view of the coat of FIG. 14.
Figure 18:
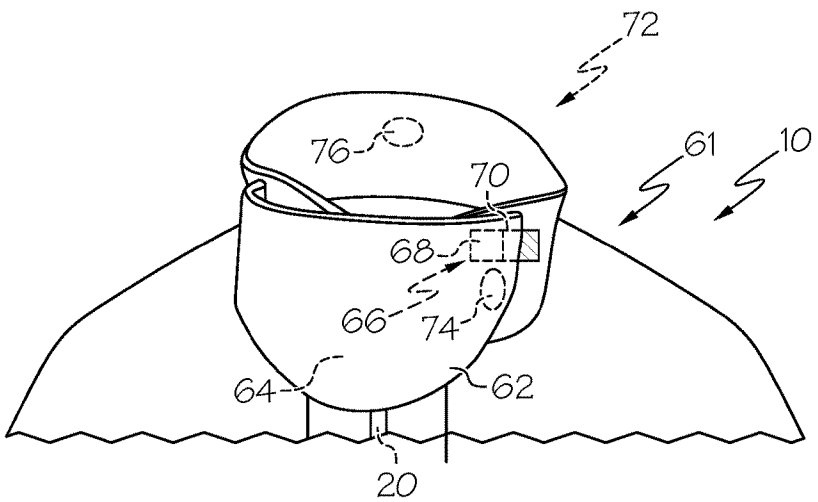
FIG. 18 is a front view of the coat of FIG. 14, with the throat tab in a different closed position.
Figure 19:
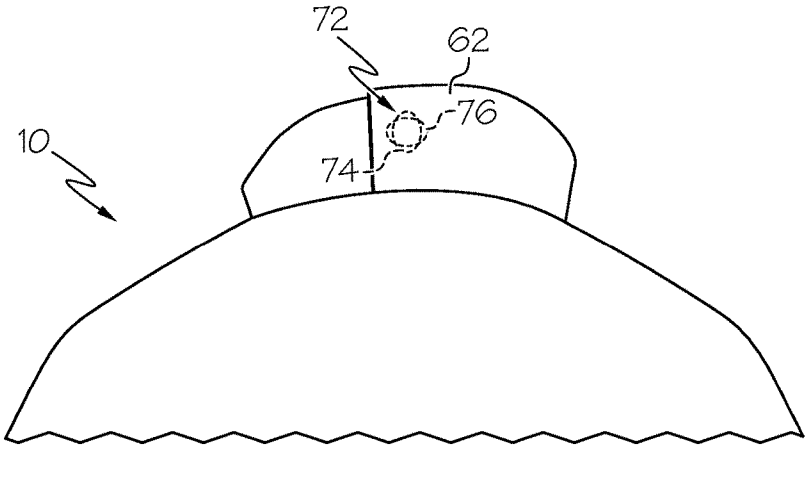
FIG. 19 is a rear view of the coat of FIG. 17.

The first 68 and/or second 70 portions can be relatively elongated to provide increased flexibility/adjustability in the operation of the throat tab closure system 61. In particular, in the embodiment shown in FIGS. 14-19, the second portion 70, located on the body 12/collar 64, is relatively elongated in the length or lateral direction (left-to-right in FIGS. 14-19). This enables the first portion 68 to be coupled to a left side (relative to a wearer) of the second portion 70, as shown in FIG. 14, to provide a relatively tight fit for the throat tab 62, or be coupled to the right side of the second portion 70 as shown in FIG. 18, to provide a relatively loose fit. The first 68 and/or second portions 70 can be elongated and have a length that is about 1.5 times in one case, or at least 2 times in another case, of the height of that portion 68, 70. Further alternatively, the first 68 and/or second 70 portion can extend in the transverse direction at least 2 inches in one case, or at least 3 inches in another case, or at least 4 inches in yet another case.

The coat 10 can include a second or magnetic fastener system 72 which can retain the throat tab 62 in the retracted position. In particular, in one case the throat tab 62 includes a first or throat magnetic coupling component 74 including a magnet and/or magnetizable portion. The throat magnetic coupling component 74 can take the form of a magnet, such as magnet 48 in combination with the backing plate 50 (see FIG. 14A), or the magnet 48 and/or backing plate 50 positioned in the support strip 46 in the same manner as the magnet systems described above or the backing plate 50 alone. The backing plate 50, if utilized, can be located on either an inner side of the magnet 48 when the throat tab 62 is in its closed position, or on an outer side of the magnet 48. In one case the throat magnetic coupling component 74 is positioned at or adjacent to a distal end of the throat tab 62 (in one case adjacent to the first portion 68 of the first fastener system 66 on the throat tab 62). The body 12/collar 64 of the coat 10, and more particularly at the back of the collar/neck portion, can include a second or body magnetic coupling component 76 in the form of a magnet and/or magnetizable portion, positioned inside the body 12/collar 64.

The throat 74 and body 76 magnetic coupling components can magnetically interact, when the throat tab 62 is in the retracted position, to retain the throat tab 62 in the retracted position. For the sake of clarity, it is noted that the throat magnetic coupling component 74 can take the form of a magnet and the body magnetic coupling component 76 can take the form of a magnetizable material, or vice versa, or both the throat 74 and body 76 magnetic coupling components can take the form of magnets 48. Moreover, if desired, the backing member 50 as described above can be utilized in conjunction with any magnets 48 utilized as the throat 74 and/or body 76 magnetic coupling component, but if desired the backing members 50 can be omitted. The magnetic fastener system 72 can utilize the various features shown and described above with respect to magnet fasteners systems utilized in other portions of the coat 10. In one case, the magnetic fastener system 72 can include multiple magnets 48 and/or backing members 50 spaced in the circumferential direction on the throat tab 62 and/or body of the coat 10 as shown in FIGS. 13, 13A and 13B and described above.

Accordingly, as can be seen, the throat tab closure system 61 includes a non-magnetic fastener system 66 to retain the throat tab 62 in a closed position, and a magnetic fastener system 72 to retain the throat tab 62 in the retracted position. In one case, on the throat tab 62, the non-magnetic fastener system 66/first portion 68 is positioned vertically above (e.g. closer to the upper edge of the collar 64 and/or throat tab 62) the throat magnetic coupling component 74 when the throat tab 62 is in its closed position to help provide a more secure coupling and reduce loose flapping of the throat tab 62. The magnetic fastener system 72 of FIGS. 14-19 includes the benefits described above for the magnetic fastener system 40 with respect to durability and ease of use for example.

In one case, because the non-magnetic fastener system 66 may remain cooler and when exposed to heat and/or not be as thermally conductive (since it can be made of non-metallic components), it may be desired to use the non-magnetic fastener system 66 along the front of the coat 10 where a wearer may be exposed to more heat and/or where the non-magnetic fastener system 66 may be exposed to more sensitive portions of the wearer (e.g. the face and/or front of the neck). In this case only a single magnet/magnetizable component/metallic component (the throat magnetic coupling component 74) is located in the front collar area when the throat tab 62 is closed, and furthermore the collar 64 is positioned between that component 74 and the wearer to provide additional protection to the wearer from the throat magnetic coupling component 74.

By locating part or all of the magnetic fastener system 72 along the back of the neck, and by not placing any magnets, metal, or magnetizable material on the front of the collar 64, the user and magnetic fastener system 72 may be more isolated and protected from front-facing heat sources. Thus, in one case, the front of the collar 64 and/or the front of the coat 10 (e.g. in one case, those portions of the collar 64/body 12 in the front half of the coronal plane) lacks any magnetic, magnetizable and/or metallic components, materials or components and/or lacks any components that the throat magnetic coupling component 74 can magnetically interact with to secure the throat tab 62 in the closed position (e.g. lacks any magnetic attraction that is sufficiently strong to sufficiently secure the throat tab 62 in place).

In addition, if a magnetic fastening system were to be used to secure the throat tab 62 in the closed position, such an arrangement could limit the adjustability of the throat tab 62; e.g. the throat tab 62 may only be able to be secured in a single position and/or with limited adjustability. Some wearers may want to the throat tab 62 to be secured in looser or tighter configuration, and the non-magnetic fastener system 66 provides greater flexibility as described above.

Figure 16:
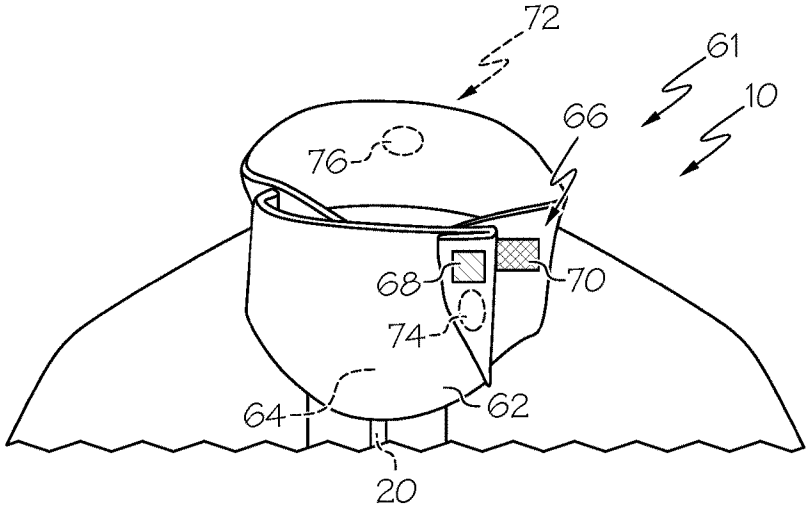
FIG. 16 is a front perspective view of a coat of FIG. 14, with an end of the throat tab folded back for illustrative purposes.
Figure 17:
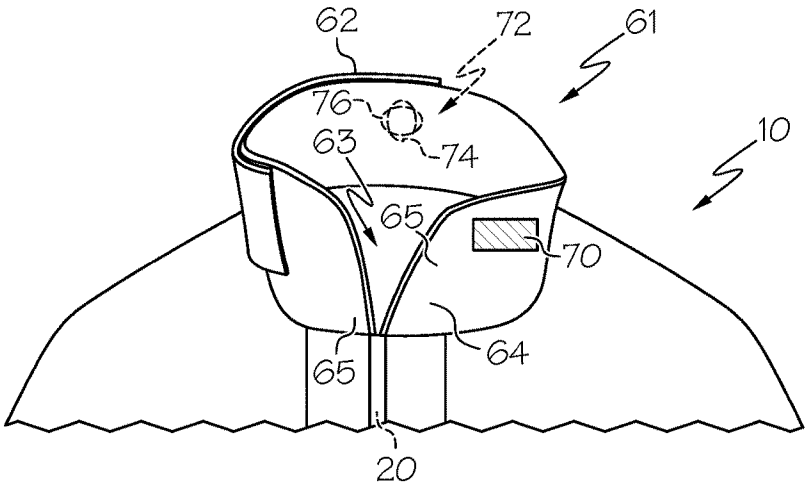
FIG. 17 is a front perspective view of the coat of FIG. 14, with the throat tab in its retracted position.

FIGS. 14, 16 and 18 show the non-magnetic fastener system 66 positioned vertically above the throat magnetic coupling component 74/second portion 70 (when the throat tab 62 is in its closed position). However this configuration can be reversed such that the throat magnetic coupling component 74/second portion 70 is positioned vertically above the non-magnetic fastener system 66 (when the throat tab 62 is in its closed position). In addition, if desired the throat magnetic coupling component 74/second portion 70 can be positioned at the same height/vertical location as non-magnetic fastener system 66 (when the throat tab 62 is in its closed position). More particularly, in this case both the throat magnetic coupling component 74/second portion 70 and the non-magnetic fastener system 66 are located at a same position in a direction through the thickness of the throat tab 62, and in one case at least partially overlap in the thickness direction. This particular configuration can help the wearer to tactually locate the throat magnetic coupling component 74, for example when coupling the throat magnetic coupling component 74 to the body magnetic coupling component 76.

Figure 20:
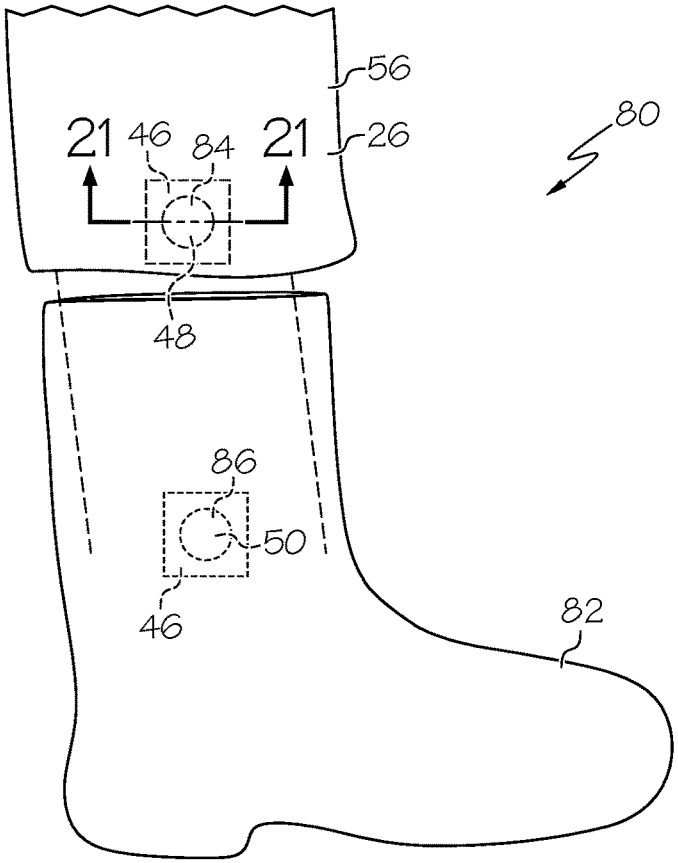
FIG. 20 is a front perspective view of a boot and a lower portion of a pair of trousers, illustrating a trousers/boot coupling system, with the trousers spaced away from the boot.
Figure 21:
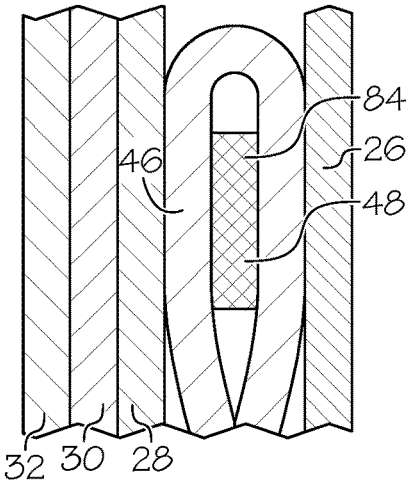
FIG. 21 is cross section taken along line 21-21 of FIG. 20.
Figure 22:
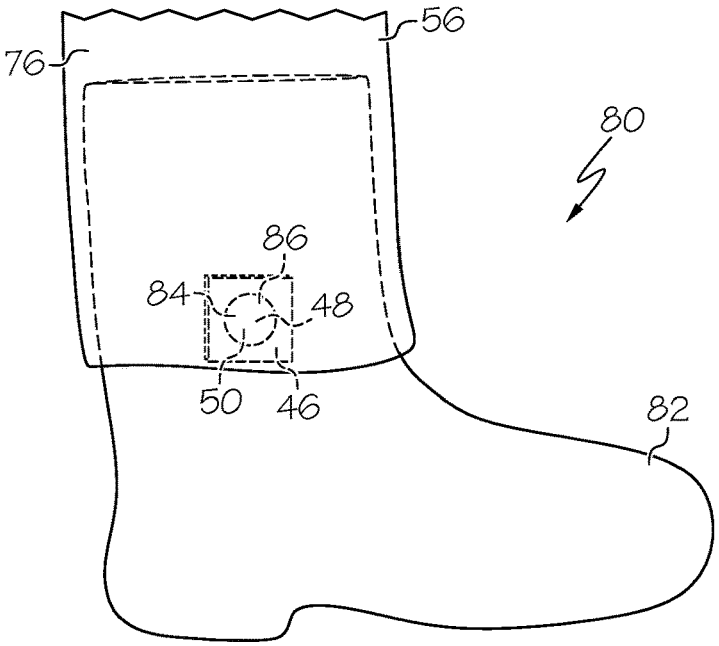
FIG. 22 illustrates the trousers and boot of FIG. 20, with the boot received inside the trousers.

With reference to FIGS. 20-22, a trouser/boot coupling system 80 can be utilized to secure the trousers 56 to one or two boots 82. In particular, in one case the trousers 56 includes a first, or trousers, magnetic coupling component 84, which can take the form of a magnet or magnetizable portion, that is permanently coupled or secured to the trousers 56, such as by stitching. The trousers magnetic coupling component 84 can be located at a lower, distal end of the trousers 56, at or adjacent to the cuff of the trousers 56, and can be located on or coupled to an inner surface of the trousers 56 (e.g. not coupled to the outer-facing surface of the outer-most layer of the trousers 56 for protection purposes). FIG. 21 shows the trousers magnetic coupling component 84 positioned between the outer shell 26 and moisture barrier 28, but the trousers magnetic coupling component 84 can be located at any position throughout the thickness of the trousers 56, in one case between the outer shell 26 and a wearer of the trousers 56. The trousers magnetic coupling component 84 can take the form of a magnet, such as magnet 48 in combination with the backing plate 50, or the magnet 48 and/or backing plate 50 positioned in a relatively short support strip 46 (see FIG. 21) in the same manner as the magnet systems described above.

In one case the trousers magnetic coupling component 84 can be entirely located in the lower 5% of the trousers 56, or in the lower 10% of the trousers 56 in another case, or in the lower 25% of the trousers 56 in yet another case, or the lower 33% of the trousers 56 in yet another case. The trousers magnetic coupling component 84 can be located at any circumferential position of the leg of the trousers 56, but in one case is located on a circumferential outer surface of the trousers 56 (opposite the inseam) or within about 15 degrees thereof. Although FIGS. 20-22 show only a single leg of the trousers 56, if desired both legs of the trousers 56 can include a trousers magnetic coupling component 84.

The trousers 56 of FIGS. 20-22 may be configured for use with a boot or boots 82 (or other footwear) which include a second, or boot, or footwear magnetic coupling component 86, which can take the form of a magnet or magnetizable portion which is permanently coupled or secured to an inner layer of the boot 82, such as by stitching. In one case the footwear magnetic coupling component 86 can be located in about a middle area of height of the boot 82, and be located at any circumferential position of the boot 82, but in one case is located on a circumferential outer surface of the boot 82 (opposite the instep) or within about 15 degrees thereof. In any case, the footwear magnetic coupling component 86 can be located at a height, and circumferential position, to be aligned with the corresponding trousers magnetic coupling component 84, or vice versa, when the trousers 56 and boots 82 are worn by a wearer.

At least one of the trousers 84 or footwear 86 magnetic coupling components may be a permanent magnet, while the other one of the associated trousers 84 or footwear 86 magnetic coupling component may be either a permanent magnet or a magnetizable material. Moreover, if desired, the backing member 50 as described above can be utilized in conjunction with any magnets 48 utilized as the trousers 84 or footwear 86 magnetic coupling components, but if desired the backing members 50 can be omitted. The trouser/boot coupling system 80 can utilize the various features shown and described above with respect to magnet fasteners systems 40 utilized in other portions of the garment.

The trousers 84 and footwear 86 magnetic coupling components can magnetically interact when the trousers 56 and boots 82 are worn to retain the trousers 56 in place and prevent the trousers 56 (in particular the legs of the trousers 56) from being pulled upwardly, thereby providing protection to the wearer's legs/ankles. The magnetic connection between the trousers 84 and footwear 86 magnetic coupling components may be able to be manually overcome by a wearer to decouple the trousers 84 and footwear 86 magnetic coupling components, thereby allowing the trousers 56 and/or boots 82 to be doffed. The trousers/boot coupling system 80 thus provide an intuitive, and easy-to-use system for coupling trousers 56 to footwear 82, with little or no extra motion required by the wearer to secure or break the connection.

Having described the invention in detail and by reference to the preferred embodiments, it will be apparent that modifications and variations thereof are possible without departing from the scope of the invention.

What is claimed is:

1. A garment comprising: a body including a first garment portion and a second garment portion; a releasable fastener configured to releasably couple the first garment portion to the second garment portion; a covering flap movable between a covering position wherein the covering flap covers the releasable fastener and a retracted position wherein the covering flap does not cover the releasable fastener; a tubular member received in one of the covering flap or the body of the garment, wherein the tubular member has an outer material and an inner foam cushioning layer; and a magnetic fastener system configured to selectively retain the covering flap in the covering position, wherein the magnetic fastener system includes: a first component positioned in the tubular member, the first component-having: a first support strip folded about itself to define a pair of plies, the support strip being made a water tight, fire resistant textile or fabric; and a plurality of first magnetic coupling components coupled to the first support strip and spaced along a length thereof, wherein each first magnetic coupling component is positioned between the pair of plies and coupled to the first support strip by stitching.

2. The garment of claim 1 wherein each first magnetic coupling component includes a backing member made of a non-magnetic, magnetizable material, and a magnet magnetically coupled to an associated backing member, and wherein the magnetic fastener system further comprises:

a second component including:

a second support strip; and a plurality of second magnetic coupling components coupled to the second support strip and spaced along a length thereof, wherein each second magnetic coupling component is at least one of a magnet or a magnetizable material, wherein the second magnetic coupling components are configured to be magnetically attracted to the first magnetic coupling components.

3. The garment of claim 2 wherein the first component is coupled to the one of the covering flap or the body of the garment, and wherein the second component is coupled to the other one of the covering flap or the body of the garment.

4. The garment of claim 2 wherein at least one of the following: each magnet of the first magnetic coupling component lacks a hole or opening formed therethrough; or each backing member of the first magnetic coupling component lacks a pin or protrusion.

5. The garment of claim 2 wherein the first component is configured such that the magnets are positioned between the backing members and a wearer of the garment in a thickness direction of the garment when the covering flap is in the covering position.

6. The garment of claim 2 wherein the first and second components are each removably coupled to the garment.

7. The garment of claim 2 wherein the first component is marked with a first indicia, and the second component is marked with a second indicia that is visually distinct from the first indicia to at least one of identify the first or second component or to identify a polarity of the associated magnetic coupling components.

8. The garment of claim 2 wherein each second magnetic coupling component includes a magnet and is oriented to have a polarity that is opposite to a polarity of the magnet of an associated one of the first magnetic coupling component when the first and second magnetic coupling components are magnetically coupled together.

9. The garment of claim 8 wherein each second magnetic coupling component includes a magnet and a backing member made of a non-magnetic, magnetizable material that is coupled to the second support strip, and magnetically coupled to an associated magnet of the second magnetic coupling component.

10. The garment of claim 2 wherein each second magnetic coupling component is made of the magnetizable material and does not include a magnet.

11. The garment of claim 2 wherein the second magnetic coupling components are spaced apart from each other by a spacing that generally corresponds to a spacing of the first magnetic coupling components, and wherein the first and second support strips are each a pliable material that is manually bendable and that is a non-magnetic, non- magnetizable material.

12. The garment of claim 2 wherein the first support strip is a continuous piece of material that generally surrounds and seals the first magnetic coupling components, and wherein the second support strip is a continuous piece of material that generally surrounds and seals the second magnetic coupling components.

13. The garment of claim 2 wherein each of the magnets of the first magnetic coupling components have about the same size and shape in front view as an associated backing member.

14. The garment of claim 2 wherein the first and second components are each generally flat and elongated, having a length at least ten times greater than a width thereof.

15. The garment of claim 2 wherein the first component is coupled to the body of the garment, wherein the second component is coupled to the covering flap of the garment, and wherein each of the second magnetic coupling components includes a magnet and lacks an associated backing member.

16. The garment of claim 15 wherein the magnetic fastener system further comprises a third component coupled to the body of the garment opposite the first component with respect to the releasable fastener, the third component including:

a third support strip; and a plurality of third magnetic coupling components coupled to the third support strip and spaced along a length thereof, wherein each third magnetic coupling component is at least one of a magnet or a magnetizable material, wherein the third magnetic coupling components are configured to be magnetically attracted to the second magnetic coupling components.

17. The garment of claim 16 wherein each third magnetic coupling component includes a backing member made of a non-magnetic, magnetizable material.

18. The garment of claim 15 wherein the magnetic fastener system further comprises a third component coupled to the body of the garment opposite the first component with respect to the releasable fastener, the third component including a third magnetic coupling component configured to be magnetically attracted to at least one of the second magnetic coupling components.

19. The garment of claim 1 wherein the releasable fastener is a zipper, wherein the garment is a coat, wherein the covering flap is a storm flap that is pivotable between the covering position and the retracted position, wherein the covering flap is permanently coupled to the first garment portion and configured to be releasably coupled to the second garment portion by the magnetic fastener system when the covering flap is in the covering position.

20. The garment of claim 1 wherein the garment is a firefighter garment including an outer shell, a thermal liner having a TPP of at least thirty and configured to be positioned between the outer shell and a wearer of the garment, and a moisture barrier configured to permit moisture vapor to pass therethrough but block liquids from passing therethrough, wherein the moisture barrier is configured to be positioned between the outer shell and a wearer of the garment.

21. The garment of claim 1 wherein the magnetic fastener system is configured to selectively retain the covering flap in the retracted position.

22. The garment of claim 1 wherein the stitching is positioned around each individual first magnetic coupling component to couple each first magnetic coupling component to the first support strip and limit a motion thereof relative to the first support strip.

23. The garment of claim 1 wherein the stitching extends through the first support strip and not through the plurality of first magnetic coupling components.

24. The garment of claim 1 wherein the pair of plies are coupled to each other via a facial bond.

25. The garment of claim 1 wherein each first magnetic coupling component includes a magnet and a backing member made of a non-magnetic, magnetizable material, and wherein each backing member has a thickness that is less than a thickness of the associated magnet.

26. The garment of claim 25 wherein each backing member has a thickness that is less than one half of the thickness of the associated magnet.

27. The garment of claim 1 wherein each first magnetic coupling component is fluidly isolated from a surrounding environment by the first support strip.

28. The garment of claim 1 wherein each first magnetic coupling component includes a generally flat magnet having a thickness less than one quarter of a longest dimension of the magnet.

29. The garment of claim 1 wherein each first magnetic coupling component includes a magnet having a pull force of between 10 lbs., and 20 lbs. at a distance of 0 inches.

30. The garment of claim 1 wherein the releasable fastener is a zipper, wherein the garment is a pair of trousers, wherein the covering flap includes a fly that is pivotable between the covering position and the retracted position, wherein the covering flap is permanently coupled to the first garment portion and configured to be releasably coupled to the second garment portion by the magnetic fastener system when the covering flap is in the covering position.

31. The garment of claim 1 wherein the tubular member has the inner foam cushioning layer on only a single side thereof, and wherein each magnetic coupling component is a magnet with a coating thereon.

32. The garment of claim 1 wherein each first magnetic coupling component includes a backing member, made of a non-magnetic, magnetizable material, and a magnet magnetically coupled to an associated backing member, wherein the tubular member is received in the body of the garment, and wherein the garment further includes a second component coupled to the covering flap, wherein the second component includes a second support strip and a plurality of second magnetic coupling components coupled to the second support strip and spaced along a length thereof, wherein each second magnetic coupling component is at least one of a magnet or a magnetizable material, wherein each second magnetic coupling component is configured to be magnetically attracted to an associated one of the first magnetic coupling components, and wherein each of the second magnetic coupling components lacks a backing member.

33. A garment comprising: a body including a first garment portion and a second garment portion; a releasable fastener configured to releasably couple the first garment portion to the second garment portion; a covering flap movable between a covering position wherein the covering flap covers the releasable fastener and a retracted position wherein the covering flap does not cover the releasable fastener; a tubular member having an outer material and an inner cushioning layer, wherein the tubular member has two outer plies, and wherein the inner cushioning layer is positioned between the two plies; and a magnetic fastener system configured to selectively retain the covering flap in the covering position, wherein the magnetic fastener system includes: a support strip positioned in the tubular member; and a plurality of magnetic coupling components spaced along a length of the support strip and positioned in the tubular member.

34. The garment of claim 33 wherein the support strip and the plurality of magnets together form a first component, and wherein the garment further includes a second component including a second support strip and a plurality of second magnetic coupling components coupled to the second support strip and spaced along a length thereof, wherein each second magnetic coupling component is at least one of a magnet or a magnetizable material, wherein the second magnetic coupling components are configured to be magnetically attracted to the magnets of the first component.

35. The garment of claim 33 wherein the support strip includes a pair of plies, each ply being made of a water tight, fire resistant textile or fabric, wherein the plurality of magnetic coupling components are positioned between the pair of plies such that the plurality of magnetic coupling components are fluidly isolated from a surrounding environment, wherein the tubular member is coupled to one of the body or the covering flap, and wherein the cushioning layer includes foam.

36. The garment of claim 35 wherein the plies of the support strip are coupled to each other via a facial bond.

37. The garment of claim 35 wherein the support strip is folded about itself to define the pair of plies.

38. The garment of claim 33 wherein the has two outer plies of the tubular memberare made of different materials.

39. The garment of claim 33 wherein an outer ply of the tubular member is thinner than the other ply of the tubular member.

40. A garment comprising: a body including a first garment portion and a second garment portion; a releasable fastener configured to releasably couple the first garment portion to the second garment portion; a covering flap movable between a covering position wherein the covering flap covers the releasable fastener and a retracted position wherein the covering flap does not cover the releasable fastener; and a magnetic fastener system configured to selectively retain the covering flap in the covering position, wherein the magnetic fastener system includes: a first support strip folded about itself to define a pair of plies; a plurality of magnetic coupling components positioned between the pair of plies of the first support strip, wherein the first support strip is removably coupled to one of the covering flap or the body of the garment; a second support strip folded about itself to define a pair of plies, wherein the second support strip is made of a water tight, fire resistant material; and a plurality of magnetic coupling components positioned between the pair of plies of the second support strip, wherein the second support strip is removably coupled to the other one of the covering flap or the body of the garment; the garment further including a tubular member receiving one of the first or second support strips, and the associated plurality of magnetic coupling components, therein, wherein the tubular member has an outer material and an inner foam cushioning layer.

41. The garment of claim 40 wherein each magnetic coupling component is coupled to the associated support strip by stitching, wherein each ply of both support strips are made of a fire resistant textile or fabric, and wherein the plurality of magnetic coupling components are spaced along a length of the associated support strip and positioned between the associated pair of plies to fluidly isolate each magnetic coupling component from a surrounding environment.

* * * * *